US006827619B2

(12) United States Patent
Oda et al.

(10) Patent No.: US 6,827,619 B2
(45) Date of Patent: Dec. 7, 2004

(54) ELECTRON EMITTING DEVICE, ELECTRON SOURCE, IMAGE FORMING APPARATUS AND PRODUCING METHODS OF THEM

(75) Inventors: Hitoshi Oda, Kanagawa-ken (JP); Takashi Iwaki, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 158 days.

(21) Appl. No.: 10/253,638

(22) Filed: Sep. 25, 2002

(65) Prior Publication Data

US 2003/0020395 A1 Jan. 30, 2003

Related U.S. Application Data

(62) Division of application No. 09/471,191, filed on Dec. 23, 1999, now Pat. No. 6,492,769.

(30) Foreign Application Priority Data

Dec. 25, 1998 (JP) ..... 10-371023
Feb. 18, 1999 (JP) ..... 11-039344

(51) Int. Cl.[7] ..... H01J 9/00; H01J 9/02
(52) U.S. Cl. ..... 445/6; 445/49; 445/50; 445/51
(58) Field of Search ..... 445/5, 6, 25, 49, 445/50, 51; 427/77

(56) References Cited

U.S. PATENT DOCUMENTS 5,532,544 A 7/1996 Yoshioka et al. ..... 313/310
5,986,389 A 11/1999 Tsukamoto ..... 313/310
6,017,259 A * 1/2000 Motoi et al. ..... 445/51
6,184,610 B1 2/2001 Shibata et al. ..... 313/309
6,221,426 B1 * 4/2001 Yamanobe ..... 427/77
6,383,047 B1 5/2002 Minami et al. ..... 445/6
6,416,374 B1 7/2002 Mitome et al. ..... 445/6

FOREIGN PATENT DOCUMENTS

EP 0 660 357 A1 6/1995
EP 0 788 130 A2 8/1997
JP 7-235255 9/1995
JP 8-7749 1/1996
JP 9-237571 9/1997
JP 2000251683 A * 9/2000 ..... H01J/9/02

* cited by examiner

*Primary Examiner*—Nimeshkumar D. Patel
*Assistant Examiner*—Maricli Santiago
(74) *Attorney, Agent, or Firm*—Fitzpatrick, Cella, Harper & Scinto

(57) ABSTRACT

In an electron emitting device, an electron source and an image forming apparatus making use of it, and producing methods of them, an organic film is present on a pair of conductive films forming the electron emitting device. This organic film is placed in an area on the conductive films. This prevents occurrence of leak paths between the conductive films, which used to occur because of change of the organic film on the substrate into a conductor where the organic film existed on the substrate outside the area of the conductive films, and prevents decrease in electron emission efficiency.

5 Claims, 16 Drawing Sheets

ELECTRON EMITTING DEVICE, ELECTRON SOURCE, IMAGE FORMING APPARATUS AND PRODUCING METHODS OF THEM

This application is a division of application Ser. No. 09/471,191, filed Dec. 23, 1999, now U.S. Pat. No. 6,492,769, issued Dec. 10, 2002.

BACKGROUND OF THE INVENTION

1. Field of the Invention

The present invention relates to an electron emitting device, an electron source, an image forming apparatus, and methods for producing them. More particularly, the invention concerns the electron emitting device with organic films thereon and, the electron source, image forming apparatus, and producing methods of them.

2. Related Background Art

The electron emitting devices conventionally known are generally classified under two types using thermionic emission elements and cold cathode emission elements. The cold cathode emission elements include the field emission (FE) type, the metal/insulator/metal (MIM) type, the surface conduction type electron emitting devices, and so on.

In some of these electron emitting devices a film of carbon or the like is laid on the device surface for the purpose of improving electron emission characteristics thereof.

For example, EP-A-660357, Japanese Patent Application Laid-Open No. 07-235255, Japanese Patent Application Laid-Open No. 08-007749, etc. describe producing methods of the electron emitting device comprising an energization forming operation of forming an electrically conductive film between device electrodes and applying voltage between the device electrodes so as to form an electron emitting region in the conductive, thin film and an activation operation, carried out thereafter, of again applying voltage between the device electrodes in an atmosphere containing a carbon compound in order to increase electron emission efficiency.

Further, Japanese Patent Application Laid-Open No. 9-237571 and EP-A-788130 describe producing methods of the electron emitting device having a step of forming films of an organic substance on the conductive film formed between the device electrodes, by applying a thermosetting resin, an electron-beam negative resist, or an organic material such as polyacrylonitrile or the like thereonto by a spin coat method and a step of carbonizing these organic substance films in order to increase the electron emission efficiency as was the case in the above.

In the producing methods described in above Japanese Patent Application Laid-Open No. 9-237571 and EP-A-788130, instability of the electron emitting device characteristics during driving is overcome by adopting a step of eliminating the organic substance films remaining on the conductive film under a reactive gas atmosphere after the above carbonization step. This suggests that in the above conventional technology the existence of the organic substance films on the conductive film forming the electron emitting device affects the electron emission characteristics during driving, and only one solution to it was the removal of the organic substance films.

SUMMARY OF THE INVENTION

An object of the present invention is to provide an electron emitting device in which the influence of the organic films laid on the electron emitting device, upon the electron emission characteristics is reduced to the utmost, and a producing method thereof.

Another object of the present invention is to provide an electron emitting device with higher electron emission efficiency, and a producing method thereof.

The present invention involves structures described below, especially.

Namely, the present invention is an electron emitting device comprising, on a substrate, a pair of electrically conductive films spaced with a gap in between, and an organic film laid on said conductive films, wherein said organic film is placed in an area on said conductive films.

The present invention is also an electron emitting device comprising, on a substrate, a pair of electrically conductive films spaced with a gap in between, and an organic film laid on said conductive films, wherein an overhang portion of said organic film from edges of said conductive films on said substrate is not more than 5 $\mu$m.

The present invention is also an electron emitting device comprising, on a substrate, a pair of conductive films spaced with a gap in between, an organic film laid on said conductive films, and carbon films laid on ends of said pair of conductive films facing the gap, wherein said organic film is placed in an area on said conductive films.

The present invention is also an electron emitting device comprising, on a substrate, a pair of conductive films spaced with a gap in between, an organic film laid on said conductive films, and carbon films laid on ends of said pair of conductive films facing the gap, wherein an overhang portion of said organic film from edges of said conductive films on said substrate is not more than 5 $\mu$m.

The present invention is also the invention of the electron emitting devices further involving the following configurations, in addition to the above configurations. Namely, said organic film is a film comprised of an organic polymer.

Further, said organic polymer is a heat-resistant organic polymer, or polyimide.

The present invention is also an electron source comprising a plurality of electron emitting devices, wherein said electron emitting devices are those described above.

The present invention is also an image forming apparatus comprising an electron source having a plurality of electron emitting devices, and an image forming member for forming an image under irradiation of electrons emitted from the electron source, wherein said electron emitting devices are those described above.

The present invention is also a method for producing an electron emitting device, the producing method comprising a step of forming an electrically conductive film on a substrate, a step of forming an organic film on said conductive film, and a step of energizing the conductive film with said organic film formed thereon, wherein said step of forming the organic film comprises a step of delivering a liquid comprising a material for forming said organic film, into an area on said conductive film by an ink jet method.

The present invention is also a method for producing an electron emitting device, the producing method comprising a step of forming an electrically conductive film on a substrate, a step of forming an organic film on said conductive film, and a step of energizing the conductive film with said organic film formed thereon, wherein said step of forming the organic film comprises a step of delivering a liquid comprising a material for forming said organic film, onto said conductive film by an ink jet method, and wherein said organic film is formed so that an overhang portion of the organic film from an edge of said conductive film on the substrate is not more than 5 μm.

The present invention is also a method for producing an electron emitting device, the producing method comprising a step of forming an electrically conductive film on a substrate, a step of forming an organic film on said conductive film, and a step of energizing the conductive film with said organic film formed thereon, wherein said step of forming the organic film comprises a step of delivering a liquid comprising a material for forming said organic film, onto said conductive film by an ink jet method, said producing method further comprising a step of making a difference in wettability against said liquid between a surface of said conductive film and a surface of said substrate, prior to said step of forming the organic film.

The present invention is also a method for producing an electron emitting device, the producing method comprising a step of forming an electrically conductive film on a substrate, a step of forming an organic film on said conductive film, and a step of energizing the conductive film with said organic film formed thereon, wherein said step of forming the organic film comprises a step of delivering a liquid comprising a material for forming said organic film, onto said conductive film by an ink jet method, said producing method further comprising a step of subjecting said substrate to a surface treatment for decreasing wettability of a surface of the substrate against said liquid, prior to said step of forming the organic film.

The present invention is also the invention of the producing methods of the electron emitting device further involving the following configurations, in addition to the above configurations. Namely, said liquid is a liquid containing polyamic acid, an amine, and an organic solvent.

Further, said amine is at least one selected from diethanolamine, triethanolamine, and trishydroxymethylaminomethane.

Said ink jet method is a method of generating a bubble in the liquid by making use of thermal energy to discharge the liquid, or a method of discharging the liquid by making use of mechanical energy.

The present invention is also a method for producing an electron source comprising a plurality of electron emitting devices, wherein said electron emitting devices are produced by the method described above.

The present invention is also a method for producing an image forming apparatus comprising an electron source having a plurality of electron emitting devices, and an image forming member for forming an image under irradiation of electrons emitted from the electron source, wherein said electron emitting devices are produced by the method described above.

The present invention described above has been accomplished based on acquisition of the following knowledge; the instability of the electron emission characteristics during driving of the electron emitting device with the organic film is caused by decrease in the electron emission efficiency resulting from the fact that the organic film of the electron emitting device becomes conductive during the producing step thereof or during driving, this results in creating leak paths of current in the gap part of the conductive films, and ohmic current flows in addition to the current related to the electron emission current.

Namely, in the case of the electron emitting device of the present invention, since the organic films formed for protection of the surface of the conductive films, or the organic films remaining as a result of the formation of the carbon films during the producing step, are placed in areas on the conductive films, this structure can prevent the creation of the leak paths in the above gap due to the change of the organic films on the substrate into conductive films in the case wherein the organic films also exist on the substrate surface outside the areas of the conductive films.

In the case of the electron emitting device of the present invention, even if the above organic films also exist on the substrate surface outside the areas of the conductive films, since the degree thereof is decreased to 5 μm or less, this can prevent the creation of such leak paths in the above gap as to considerably degrade the electron emission characteristics.

Here the above term "5 μm or less" means, as illustrated in FIG. 6C described hereinafter, that a maximum overhang portion D of the above organic films 41 from an edge of the above conductive films 4 on the substrate 1 is not more than 5 μm.

According to the producing method of the electron emitting device of the present invention, the formation of the above organic films comprises the step of delivering the liquid containing the material for formation of the organic films into areas on the conductive films by the ink jet method, whereby the organic films can be formed in the areas on the conductive films, as described above, thereby preventing the creation of leak paths in the above gap.

The method of delivering the above liquid into the areas on the above conductive films by the ink jet method became possible, for example, by controlling the composition of the above liquid, as described hereinafter.

According to the producing method of the electron emitting device of the present invention, the formation of the above organic films is carried out after the difference in wettability against the liquid delivered is made between the surface of the above conductive films and the surface of the above substrate in delivering the above liquid onto the conductive films by the ink jet method, preferably, after the above substrate is subjected to the surface treatment to decrease the wettability of the substrate surface against the above liquid, whereby the organic films are formed within the areas on the above conductive films, or, even if the organic films are also formed on the substrate surface outside the areas of the conductive films, the degree thereof is 5 μm or less as stated above, thereby preventing the creation of leak paths in the above gap.

As described above, according to the electron emitting device of the present invention and the producing method thereof, it is extremely rare, especially, for part of the organic films of the device to become conductive during the producing step or during driving so as to allow flow of the ohmic current in addition to the current related to the electron emission current, thereby decreasing the electron emission efficiency, and thus the good device is obtained.

DETAILED DESCRIPTION OF THE PREFERRED EMBODIMENTS

The particularly preferred embodiments of the present invention will be detailed below.

First, preferred examples of the electron emitting device of the present invention will be described using FIG. 1A, FIG. 1B, and FIG. 6A to FIG. 6C.

Figure 1A:
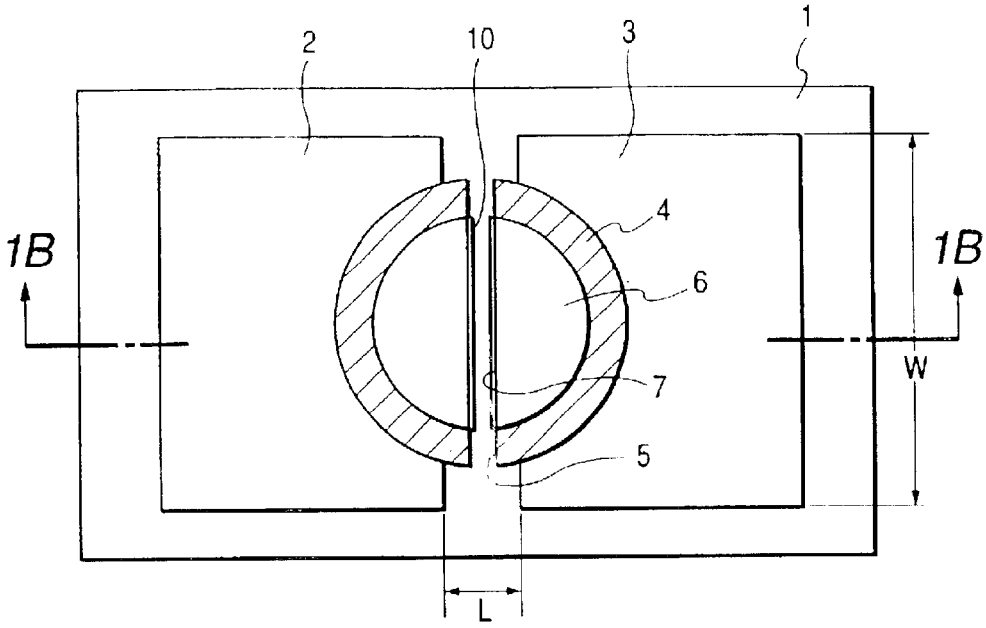
FIG. 1A and FIG. 1B are a schematic, plan view and cross-sectional view to show an example of the electron emitting device of the present invention.
Figure 1B:
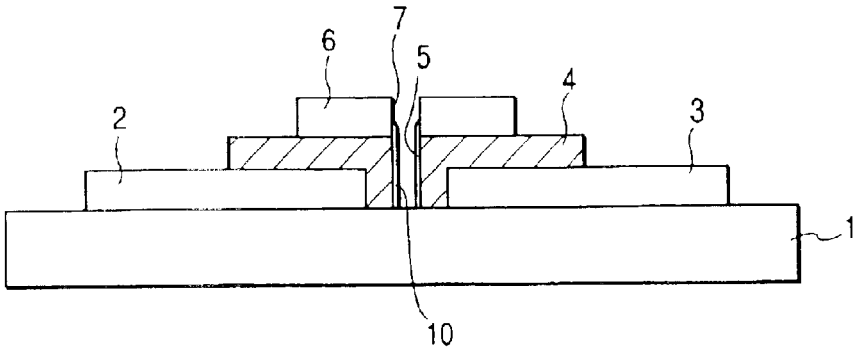

FIG. 1A and FIG. 1B are schematic diagrams to show the first embodiment of the electron emitting device of the present invention, wherein FIG. 1A is a plan view and FIG. 1B is a cross-sectional view.

The electron emitting device illustrated in FIG. 1A and FIG. 1B is a surface conduction type electron emitting device, and in FIG. 1A and FIG. 1B, reference numeral 1 designates a substrate, 2 and 3 electrodes, 4 electrically conductive films, 6 organic films, 5 a first gap of a fissure or the like of the conductive films, 7 a second gap of a fissure or the like of the organic films, and carbon films 10 are laid at least on ends in the first gap out of the first and second gaps.

The substrate 1 herein can be one selected from those made of quartz glass, glass with a reduced content of impurities such as Na or the like, a glass substrate in which $SiO_2$ is deposited on glass by sputtering or the like, and so on.

The opposed electrodes 2, 3 can be made of a material selected from ordinary, electrically conductive metal materials. The material is properly selected, for example, from metals such as Ni, Cr, Au, Mo, W, Pt, Ti, Al, Cu, Pd, and so on, or alloys thereof; or printed conductors comprised of a metal or a metallic oxide such as Pd, Ag, Au, $RuO_2$, Pd-Ag, or the like, glass, etc.; or transparent conductors such as $In_2O_3$—$SnO_2$ or the like; or semiconductor materials such as polysilicon or the like; and so on.

Besides the structure illustrated in FIG. 1A and FIG. 1B, the device can also be constructed in such structure that the conductive films 4 and the opposed electrodes 2, 3 are stacked in the stated order on the substrate 1.

A material for formation of the conductive films 4 can be one selected, for example, from metals such as Pd, Pt, Ru, Ag, Au, Ti, In, Cu, Cr, Fe, Zn, Sn, Ta, W, Pb, and the like; oxide conductors such as PdO, $SnO_2$, $In_2O_3$, PbO, $Sb_2O_3$, and the like; borides such as $HfB_2$, $ZrB_2$, $LaB_6$, $CeB_6$, $YB_4$, $GdB_4$, and the like; carbides such as TiC, ZrC, HfC, TaC, SiC, WC, and the like; nitrides such as TiN, ZrN, HfN, and the like; semiconductors such as Si, Ge, and the like; carbon; and so on.

The conductive films 4 are preferably fine particle films composed of fine particles in order to yield good electron emission characteristics. The thickness is properly set in consideration of the step coverage over the device electrodes 2, 3, the resistance between the device electrodes 2, 3, etc., but normally it is preferably in the range of several A to several hundred nm and more preferably in the range of 1 nm to 50 nm. The resistance, Rs (sheet resistance), is preferably a value in the range of $10^2$ Ω/□ to $10^7$ Ω/□.

The carbon films 10 are made of carbon or a carbon compound and are placed on the ends of the conductive films 4 facing the first gap 5, as illustrated in FIG. 1A and FIG. 1B, so as to form a third gap narrower than the gap 5 of the conductive films 4.

The organic films 6 formed on the conductive films 4 are placed in top surface areas of the conductive films 4, as illustrated in FIG. 1A and FIG. 1B, and no organic film 6 exists on the surface of the substrate 1 between the electrodes 2, 3. Here a material for the organic films is preferably an organic polymer material, which is selected, for example, from furfuryl alcohol, furan resin, phenol resin, polyacrylonitrile, rayon, glycidyl methacrylate-ethyl acrylate copolymers, poly (diallyl phthalate), glycidyl acrylate-styrene copolymers, polyamic acid, polyimide, epoxidized 1,4-polybutadiene, poly (glycidyl methacrylate), and so on. Further, the material preferably has high heat resistance, because it experiences an electron emitting region forming step by energization described hereinafter, a baking step for cleaning the surface of the electron emitting device and the inside of a vessel enclosing the electron emitting device, and so on. Known examples of organic materials having sufficient heat resistance include poly (ether ether ketone), polyamideimide, polyimide, and so on, and among these heat-resistant organic materials polyimide is preferable, particularly, in terms of easiness of film formation etc., because polyamic acid as a precursor thereof is solvent-soluble. Among polyimide resins aromatic polyimide is particularly preferable in terms of the heat resistance.

Polyamic acid as a precursor of polyimide is well soluble in such organic solvents as N-methylpyrrolidone (NMP), N,N-dimethylformamide (DMF), dimethyl sulfoxide (DMSO), and so on. A polyimide film can be formed by applying a solution of polyamic acid by the ink jet method, and drying and baking it.

For applying the solution of polyamic acid as a precursor of polyimide by the ink jet method, it is recommendable to use the solution in a relatively low concentration of polyamic acid, 1% or less, in order to avoid clogging of a nozzle, high discharge voltage, or the like, because the solvent itself for dissolving polyamic acid has a relatively high viscosity.

The inventor found out that in applying polyamic acid as a precursor of polyimide by the ink jet method a small dot of polyamic acid was able to be formed by setting the concentration of polyamic acid at a slightly high level while experiencing no clogging of the nozzle and keeping the discharge voltage within a permissible range and that a polyimide dot of small diameter was able to be obtained by baking the polyamic acid dot.

The concentration of polyamic acid as a precursor of the polyimide film is determined as follows. Since polyamic acid is a polymer, the viscosity of the solution is slightly high. If the concentration of polyamic acid is set at a relatively high level the viscosity of the solution will be increased and thus a delivery amount will be decreased. This will result in decreasing the diameter of the polyimide dot. The viscosity suitable for delivery is achieved in the concentration range of about 2% to 4%.

Further, it was also found that the diameter of the polyimide dot decreased when an organic amine was added into the polyamic acid solution. This is conceivably because polyamic acid reacts with the organic amine to make an ammonium salt, thereby increasing the viscosity. The organic amine used here is preferably one of alcohol amines such as diethanolamine, triethanolamine, trishydroxymethylaminomethane, and so on. The concentration of the organic amine is preferably 2% to 20% from the aspects of the discharge property of the ink jet method and the viscosity of the solution.

When the solution obtained by adding the organic amine to the polyamic acid solution of the high concentration as described above, which was the applied solution, was a solution in which polyamic acid of 2% to 4% and the organic amine of 2% to 20% were dissolved in the organic solvent such as N-methylpyrrolidone (NMP) or the like and when it was applied in a reduced delivery amount by the ink jet method, polyimide films were able to be formed only on the conductive films or as limited on the conductive films.

When the application step is carried out, particularly, by the ink jet method as described above, the organic films of polyimide can be laid only on the conductive films, which can decrease the possibility that the diameter of the polyimide dot becomes large, the polyimide film projects out onto the substrate at the border between the conductive films and the substrate, part thereof becomes conductive upon the energization operation of the polyimide film, and the ohmic current flows in addition to the current associated with the electron emission current.

Further, in the producing method of the electron emitting device having the steps of laying viscous polyamic acid containing the organic amine only on the conductive films on the pair of electrodes placed on the substrate, by the ink jet method, thereafter baking it into polyimide, and then applying the voltage to the pair of electrodes, a constant amount of polyimide can be formed only on the conductive films by the ink jet method; therefore, the electron emitting device can be produced easily, the method decreases the possibility that part of the polyimide film becomes conductive upon the energization operation of the polyimide film to allow flow of the ohmic current in addition to the current associated to the electron emission, it can realize the device with high electron emission efficiency and with a long life, and the image forming apparatus can also be produced with uniform quality over a large area easily and at low cost.

The electron emitting device of the first embodiment described above is a device that emits electrons from the vicinity of the above third gap formed between the carbon films 10 by applying a predetermined voltage between the pair of electrodes 2, 3, which can thus be mentioned as an electron emitting device having the electron emitting region in the conductive films 4.

Figure 6A:
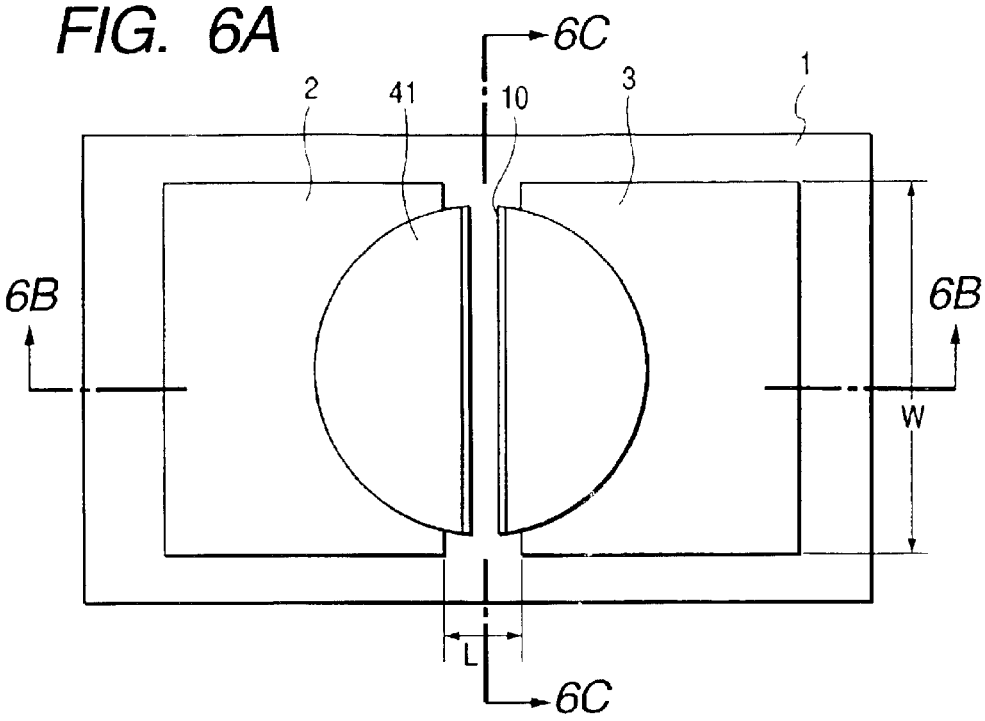
FIG. 6A, FIG. 6B, and FIG. 6C are a schematic, plan view and cross-sectional views to show another example of the electron emitting device of the present invention.
Figure 6B:
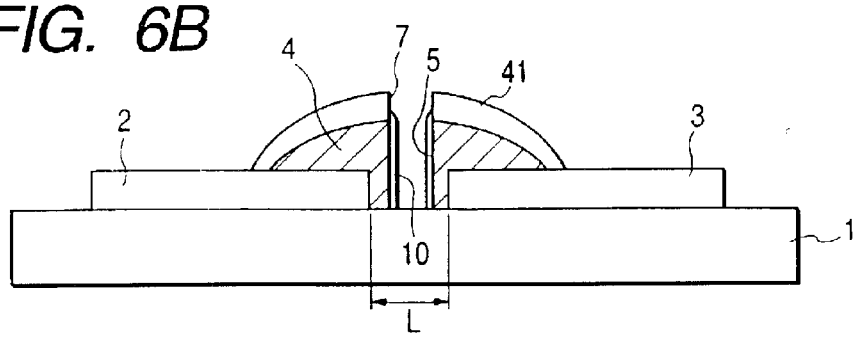
Figure 6C:
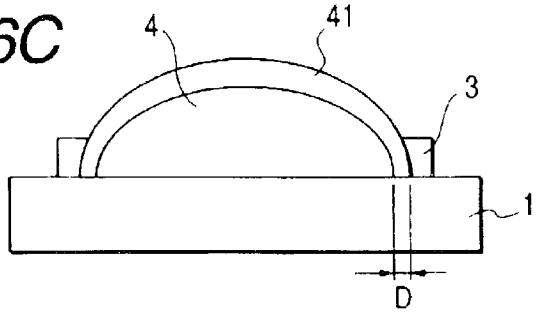

Next, FIG. 6A to FIG. 6C are schematic diagrams to show the second embodiment of the electron emitting device of the present invention, wherein FIG. 6A is a plan view, FIG. 6B a cross-sectional view along 6B—6B of FIG. 6A, and FIG. 6C a cross-sectional view along 6C—6C of FIG. 6A.

The electron emitting device illustrated in FIG. 6A to FIG. 6C is a surface conduction type electron emitting device, and in FIG. 6A to FIG. 6C, reference numeral 1 designates the substrate, 2 and 3 the electrodes, 4 the conductive films, 41 the organic films, 5 the first gap of a fissure or the like of the conductive films, 7 the second gap of a fissure or the like of the organic films, and the carbon films 10 are laid at least on the ends in the first gap out of the first and second gaps.

The substrate 1, electrodes 2, 3, conductive films 4, organic films 41, and carbon films 10 in the present embodiment are similar to those in the first embodiment described above.

In the present embodiment, as illustrated in FIG. 6C, the organic films 41 also exist on the surface of the substrate 1 outside the top surface areas of the conductive films 4. However, the maximum overhang portion D of the organic films 41 from the edge of the conductive films 4 on the surface of the substrate 1 is 5 $\mu$m on the surface of the substrate 1. Namely, the overhang portions D of the organic films 41 from the edges of the conductive films 4 on the surface of the substrate 1 are not more than 5 $\mu$m.

In the electron emitting device of the present embodiment, the carbon films 10 are also laid on the ends of the conductive films 4 facing the first gap 5, as illustrated in FIG. 6A to FIG. 6C, so as to form the third gap narrower than the gap 5 of the conductive films 4, and electrons are emitted from the vicinity of the above third gap formed by the carbon films 10 with application of the predetermined voltage between the pair of electrodes 2, 3. Therefore, the electron emitting device of the present embodiment can also be mentioned as an electron emitting device having the electron emitting region in the conductive films 4.

The producing methods of the surface conduction electron emitting devices of the first and second embodiments described above will be explained below with examples thereof.

First, examples of steps of the producing method of the electron emitting device illustrated in FIG. 1A and FIG. 1B, which is the first embodiment of the producing method of the electron emitting device, will be explained referring to FIG. 2A to FIG. 2D and FIG. 3E to FIG. 3G.

Figure 2A:
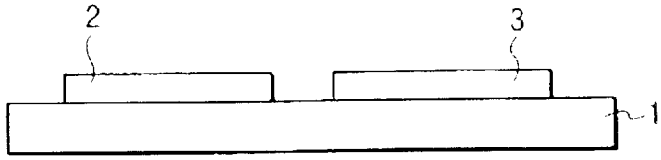
FIG. 2A, FIG. 2B, FIG. 2C and FIG. 2D are schematic diagrams to show an example of the producing method of the electron emitting device illustrated in FIG. 1A and FIG. 1B.

(1) The substrate 1 is cleaned well with detergent, pure water, and an organic solvent or the like, the material for the device electrodes is deposited thereon by vacuum evaporation, sputtering, or the like, and thereafter the device electrodes 2, 3 are formed on the substrate 1, for example, by the photolithography technology (FIG. 2A).

Figure 2B:
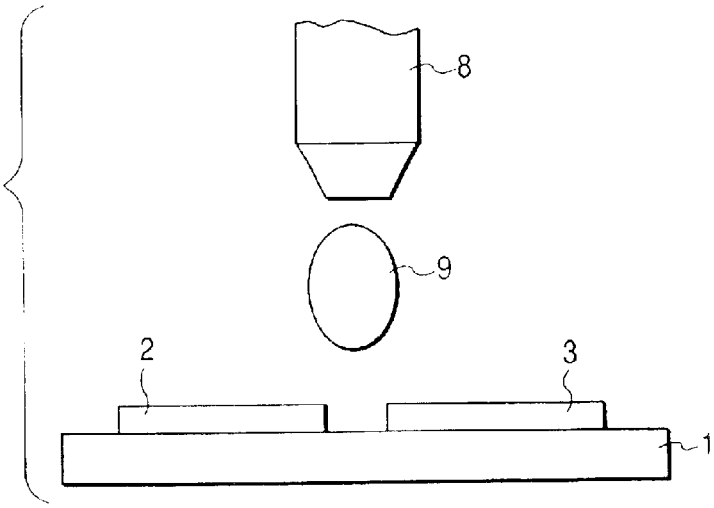
Figure 2C:
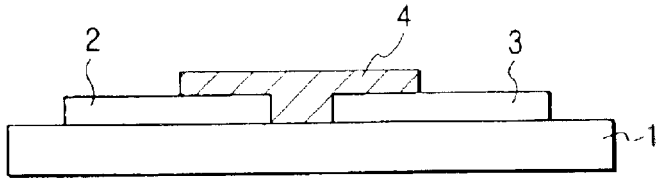

(2) A solution of a metallic compound is applied (droplets thereof are delivered) onto the substrate 1 provided with the device electrodes 2, 3, by the ink jet method (FIG. 2B), and it is dried and baked to form the conductive film 4 of the metallic compound (FIG. 2C). The ink jet method is available as a method of generating a bubble in a liquid by use of thermal energy to discharge the liquid, which is so called a bubble jet method, or as a method of discharging the liquid by use of mechanical energy, which is called a piezo method, and either method may be applied.

The above drying step can be carried out using one of air drying, blast drying, hot air drying, etc. normally used, and the above baking step can be one of heating means normally used. The drying step and baking step do not always have to be carried out as separate steps discriminated from each other, but may also be carried out continuously and simultaneously.

Figure 2D:
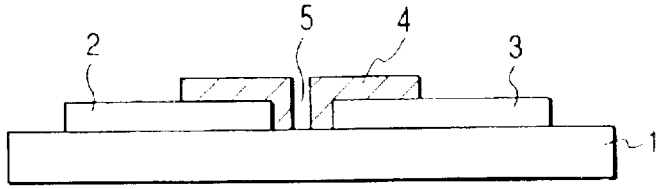

(3) Subsequent to it, a step called a forming operation is carried out. A method by the energization operation will be explained as an example of the method of this forming step. When the voltage is placed between the device electrodes 2, 3 by use of an unrepresented power supply, the gap part 5 of a fissure or the like is created in a portion of the conductive film 4 (FIG. 2D). Examples of voltage waveforms in the energization forming are presented in FIG. 4A and FIG. 4B.

Preferred voltage waveforms are pulse waveforms. For them, there are a technique illustrated in FIG. 4A in which pulses with pulse peak values of a constant voltage are applied successively, and a technique illustrated in FIG. 4B in which voltage pulses with increasing pulse peak values are applied.

Figure 4A:
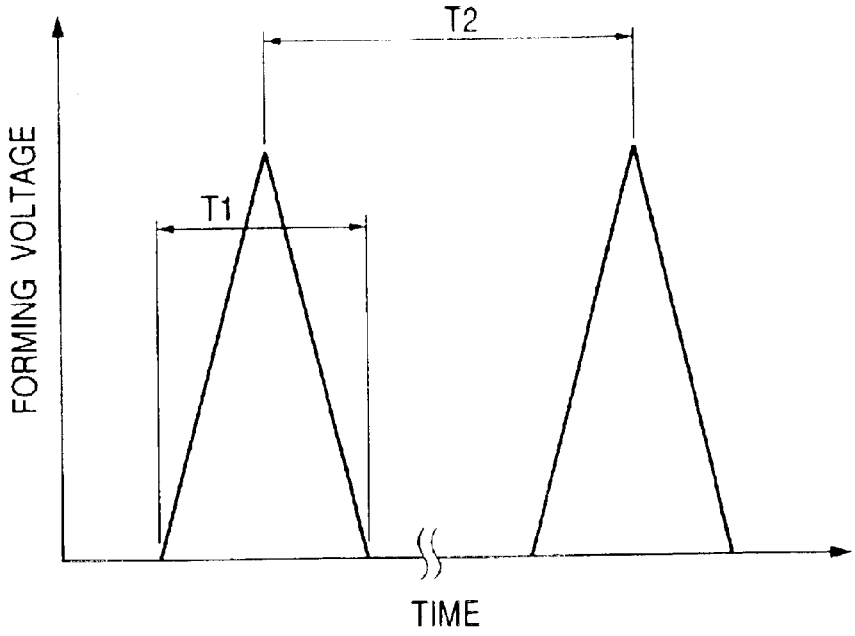
FIG. 4A and FIG. 4B are schematic diagrams each of which shows an example of voltage waveform in the energization forming operation, which can be employed in the production of the electron emitting device according to the present invention.

In FIG. 4A T1 and T2 represent the pulse width and pulse separation of the voltage waveform. Normally, T1 is set in the range of 1 $\mu$sec to 10 msec, and T2 in the range of 10 $\mu$sec to 100 msec. The peak values of triangular waves (peak voltages upon the energization forming) are properly selected according to the type of the surface conduction electron emitting device. Under these conditions, for example, the voltage is applied for several seconds to several ten minutes. The pulse waveforms are not limited to the triangular waves, but any desired waveform such as rectangular waves can be adopted.

Figure 4B:
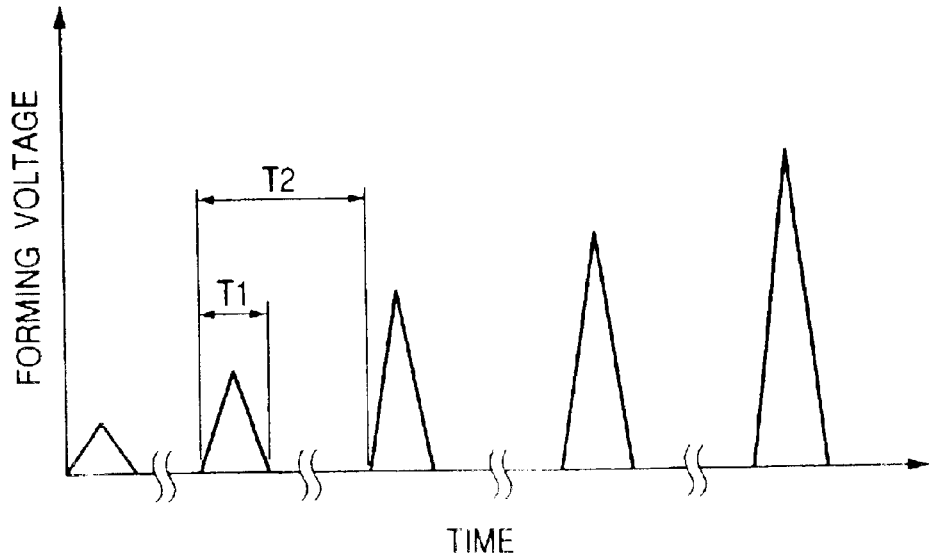

In FIG. 4B T1 and T2 can be similar to those illustrated in FIG. 4A. The peak values of triangular waves (peak voltages upon the energization forming) can be increased, for example, in steps of about 0.1 V.

The end of the energization forming operation can be detected by applying a voltage too weak to locally break or deform the conductive film 4 during the pulse separation T2, and measuring an electric current.

(4) Next, the organic film 6 is formed on the conductive films 4 of the device having passed through the above forming step. This formation of the organic film 6 is carried out by delivering the solution containing the component material of the organic film into the top surface areas of the conductive films 4 by the ink jet method, and drying and baking it. The ink jet method in this case can also be either the above bubble jet method or the above piezo method.

A technique for delivering the solution containing the constituent material of the organic film into the top surface areas of the conductive films 4 by the ink jet method can be, for example, a method for properly controlling the composition of the solution delivered.

In the present embodiment, the above solution delivered by the ink jet method is preferably an organic solution of N-methylpyrrolidone (NMP) or the like containing polyamic acid as a precursor of polyimide in the concentration range of 2% to 4% and containing the organic amine, preferably, alcohol amine such as diethanolamine, triethanolamine, trishydroxymethylaminomethane, or the like in the concentration range of 2% to 20%.

On the occasion of delivery of the above solution, an impact position is controlled so that the polyamic acid solution can be applied onto the center of the conductive films, so as to be delivered only onto the conductive films. With increase in the number of overlap deliveries on the conductive films the diameter of the polyamic acid dot tends to increase and the suitable number of deliveries is five or less. The thickness of the polyimide film will be 10 nm to 150 nm, depending upon the dot diameter, the concentration, and the number of deliveries.

Figure 3E:
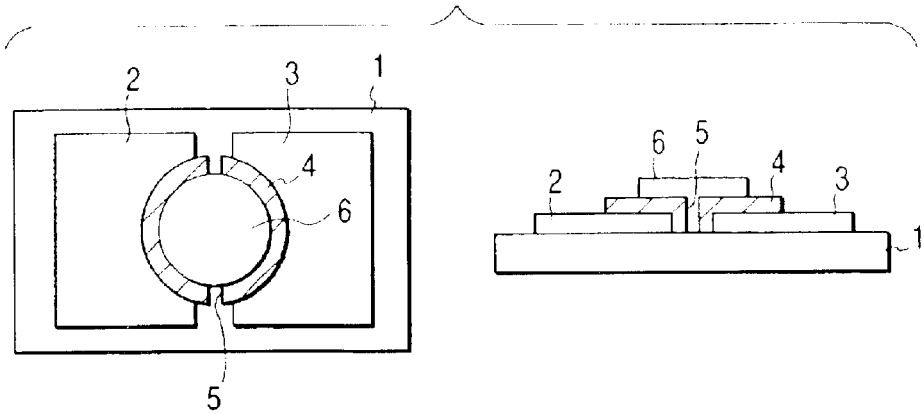
FIG. 3E, FIG. 3F and FIG. 3G are schematic diagrams to show an example of the producing method of the electron emitting device illustrated in FIG. 1A and FIG. 1B.

After the solution containing the material for formation of the organic film has been delivered onto the conductive films as described above, it is dried and baked to form the organic film 6 (FIG. 3E).

(5) Then the conductive films 4 are subjected to an energization operation, whereupon the fissure 7 is also created in the organic film 6 and the organic films 6 are further carbonized near the fissure 7.

Figure 3F:
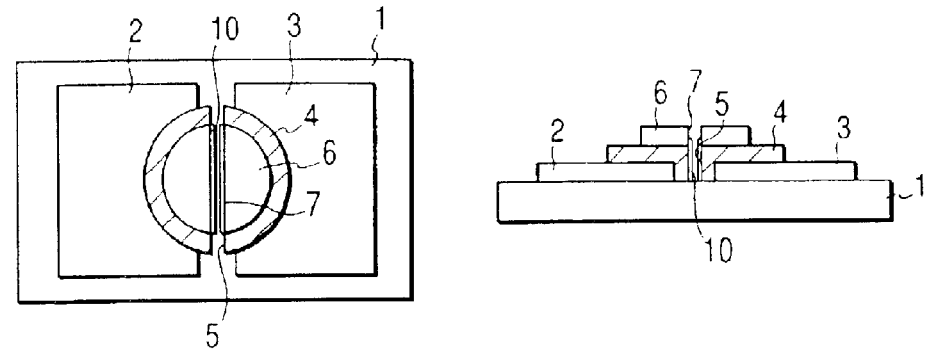

Therefore, carbon films are formed on the ends of the conductive films 4 facing the fissure 5 of the conductive films 4 (FIG. 3F).

In the producing method described above, the order of the above forming operation step (3) and the step (4) of formation of the organic film can be reverse.

Namely, the step (FIG. 3G) of forming the organic film on the conductive thin film 4 formed by above step (2) is carried out as step (3') in the like manner as illustrated in above step (4), and thereafter, the step of the energization forming operation is carried out as step (4') in the like manner as in above step (3). This results in creating the fissures 5, 7 in both the conductive film 4 and organic film 6, and in this case the organic films 6 are also carbonized near the fissure 7, whereby the carbon films 10 are formed on the ends of the conductive films 4 facing the fissure 5.

(6) The electron emitting device produced as described above is then subjected preferably to an operation called a stabilization step. The stabilization step is a step of uniformizing the electron emission characteristics by driving the electron emitting device formed through the carbonization step, in a high vacuum. A vacuum evacuation device for evacuating a vacuum vessel is preferably one using no oil so that oil evolving from the device can be prevented from affecting the device characteristics. Specifically, it can be one selected from the vacuum evacuation devices such as an absorption pump, an ion pump, and so on.

The partial pressure of organic components in the vacuum vessel is one under which no new deposition occurs of carbon and a carbon compound, and is preferably not more than $1.3\times10^{-6}$ Pa and particularly preferably not more than $1.3\times10^{-8}$ Pa.

Further, on the occasion of evacuating the inside of the vacuum vessel, it is preferable to heat the whole vacuum vessel, so as to facilitate exhaust of organic substance molecules adhering to the walls inside the vacuum vessel and to the electron emitting device. A heating condition at this time is desirably 80 to 200° C. and five hours or more, but it does not have to be limited, particularly, to this condition. The heating is carried out under a condition properly selected depending upon various conditions including the size and shape of the vacuum vessel, the structure of the electron emitting device, and so on.

The pressure inside the vacuum vessel needs to be as low as possible and is preferably not more than $1.3\times10^{-5}$ Pa and particularly preferably not more than $1.3\times10^{-6}$ Pa.

The atmosphere during driving after execution of the stabilization step is preferably the one at the end of the above stabilization operation, but it does not have to be limited to this. As long as the organic substance is removed well, sufficiently stable characteristics can be maintained even with some deterioration of the vacuum degree itself.

Adoption of this vacuum atmosphere can suppress the new deposition of carbon or the carbon compound, so that the device current If and emission current Ie become stable.

Next, an example of steps of the producing method of the electron emitting device illustrated in FIG. 6A to FIG. 6C, as the second embodiment concerning the producing method of the electron emitting device, will be described referring to FIG. 7A to FIG. 7E and FIG. 8F to FIG. 8H.

Figure 7A:
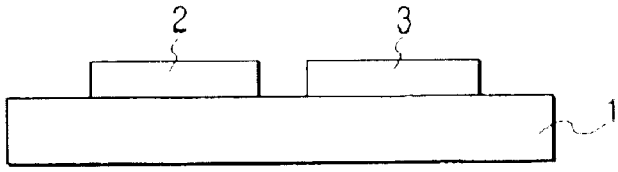
FIG. 7A, FIG. 7B, FIG. 7C, FIG. 7D and FIG. 7E are schematic diagrams to show an example of the producing method of the electron emitting device illustrated in FIG. 6A, FIG. 6B and FIG. 6C.

1) The substrate 1 is cleaned well with detergent, pure water, and the organic solvent or the like, the material for the device electrodes is deposited thereon by vacuum evaporation, sputtering, or the like, and thereafter the electrodes 2 and 3 are formed on the substrate 1, for example, by the photolithography technology (FIG. 7A).

Figure 7B:
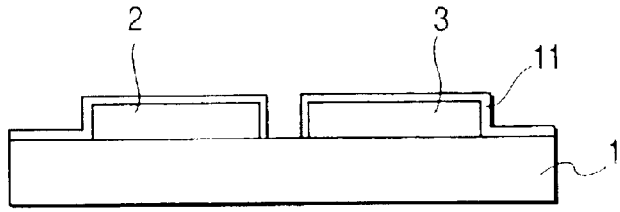

2) The surface of the substrate 1 with the electrodes 2, 3 formed thereon is then subjected to a surface treatment, thereby forming a surface treatment layer 11 (FIG. 7B).

Generally speaking, for example, surfaces of clean glass, metal, and metallic oxides readily get wet with such solutions as water or the like, whereas surfaces of organic compounds such as plastics or the like are resistant to becoming wet. Since the wettability of the surface of the substrate originates in the surface structure, the surface can be made resistant to becoming wet with these solutions by a hydrophobicity-introducing treatment of the substrate surface to introduce a hydrocarbon group, a fluorocarbon group, or the like of highly hydrophobic nature to the surface of the substrate.

In the present embodiment, the hydrophobicity-introducing treatment is carried out suitably using an organic silicon compound having the hydrophobic group of hydrocarbon, fluorocarbon, or the like, and the treatment can be carried out by a coating method such as spin coating, spray coating, or the like, or by vapor phase deposition.

The organic silicon compound is one selected, for example, from alkoxy silanes such as trimethylmethoxysilane, dimethyldimethoxysilane, methyltrimethoxysilane, methyldimethoxysilane, trimethylethoxysilane, methyltriethoxysilane, methyldiethoxysilane, triphenylmethoxysilane, diphenyldimethoxysilane, phenyltrimethoxysilane, triphenylethoxysilane, diphenyldiethoxysilane, phenyltriethoxysilane, and so on.

The organic silicon compound can also be one selected from vinylsilanes such as vinyltrichlorosilane, vinyltrimethoxysilane, vinyltriethoxysilane, vinyltris (β-methoxyethoxy) silane, and so on.

Further, the organic silicon compound can be one selected from organic functional silanes such as γ-chloropropyltrichlorosilane, γ-chloropropyltrimethoxysilane, γ-chloropropyltriethoxysilane, γ-aminopropyltrimethoxysilane, γ-aminopropyltriethoxysilane, γ-aminopropylmethyldiethoxysilane, N-β (aminoethyl)-γaminopropyltrimethoxysilane, N-β (aminoethyl)-γaminopropylmethyldimethoxysilane, γ-glycidoxypropyltrimethoxysilane, γ-methacryloxypropyltrimethoxysilane, γ-mercaptopropyltrimethoxysilane, and so on.

The organic silicon compound can also be one selected from fluoroalkylsilanes (also including those of C4 and more) such as fluoroethyltrimethoxysilane, γ-fluoropropyltrimethoxysilane, fluoroethyldimethoxyethoxysilane, fluoroethylmethyldiethoxysilane, perfluoroethyltrimethoxysilane, perfluoroethyltriethoxysilane, perfluoropropyltrimethoxysilane, perfluoropropyltriethoxysilane, and so on.

Further, the organic silicon compound can also be one selected from disilanes such as hexamethyldisilane and the like, silazanes such as hexamethyldisilazane, hexamethylcyclotrisilazane, and so on, silanols such as diphenylsilane-diol and the like, silylamides such as N-(trimethylsilyl) acetamide, bis (trimethylsilyl) acetamide, N,N'-bis (trimethylsilyl) urea, and the like, and so on.

In addition to the above, it can also be the silicone resin or the fluororesin commonly used as a water-repellent material.

Figure 7C:
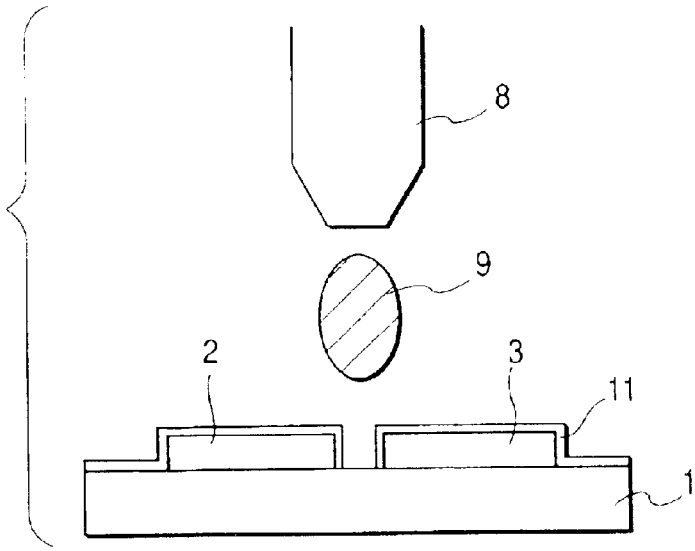

3) The solution containing the material for formation of the conductive film 4 is delivered onto the surface-treated substrate 1 (FIG. 7C). FIG. 7A to FIG. 7E show an example of the method of delivering a droplet 9 of the solution containing the material for formation of the conductive film 4 by use of a droplet delivery device 8. The area and thickness of the conductive film 4 can be controlled by adjusting an amount of the droplet 9. The ink jet method is used preferably for the above delivery of the droplet and this ink jet method is available as a method for generating a bubble in a liquid by use of thermal energy to discharge the liquid, which is so called the bubble jet method, or as a method for discharging the liquid by use of mechanical energy, which is called the piezo method, either of which may be applied.

Figure 7D:
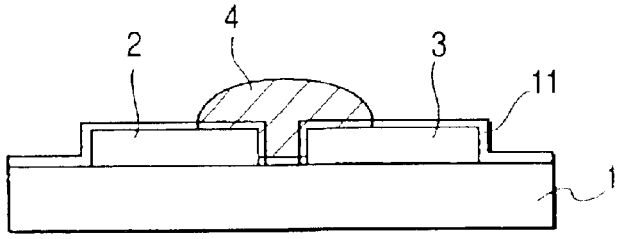

4) After the delivery of the droplet 9 of the solution containing the material for formation of the conductive film 4 as described above, it is dried and is subjected to a heat treatment or the like if necessary, thereby forming the conductive film 4 (FIG. 7D). The example of delivering the droplet 9 was described as a forming method of the conductive film, but the forming method is not limited to this example. The conductive film can also be formed by depositing a film by evaporation, sputtering, spin coating, or a printing method and patterning the film by photolithography or the like.

Figure 7E:
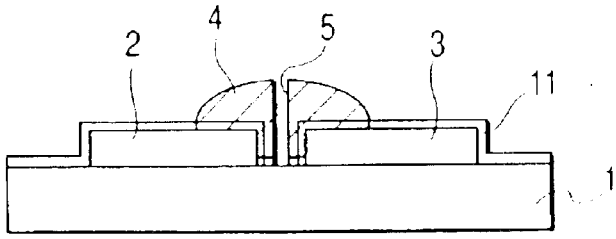

5) Next, the gap 5 of a fissure or the like is created in the above conductive film 4 by carrying out a step called the forming operation, similar to that in the first embodiment concerning the producing method of the above electron emitting device (FIG. 7E).

Figure 8F:
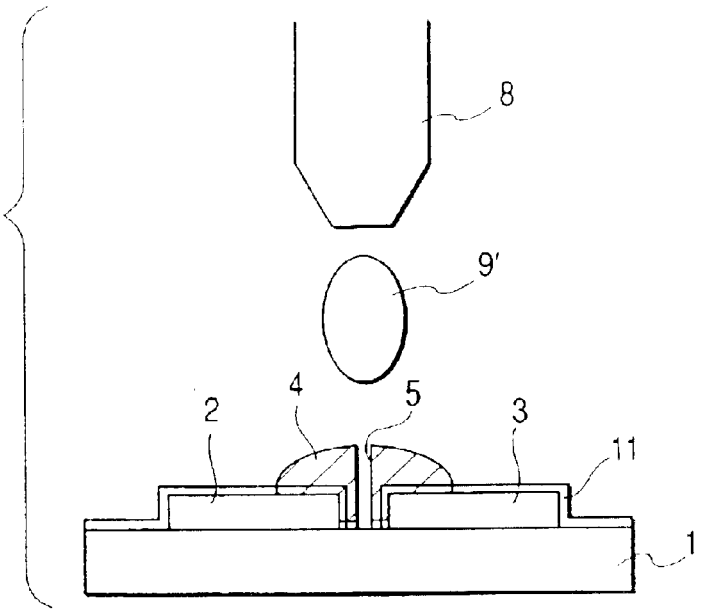
FIG. 8F, FIG. 8G and FIG. 8H are schematic diagrams to show an example of the producing method of the electron emitting device illustrated in FIG. 6A, FIG. 6B and FIG. 6C.
Figure 8G:
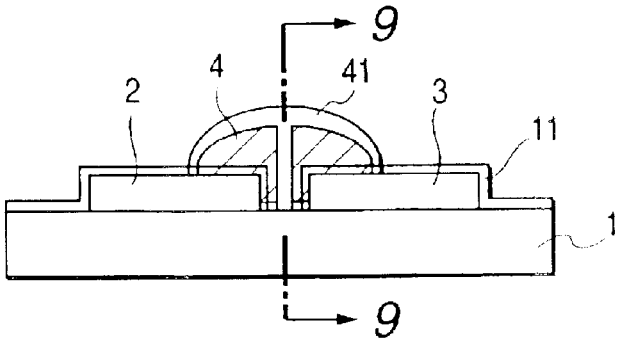

6) Then a droplet 9' of the solution containing the organic material is delivered onto the conductive films 4 with the droplet delivery device 8 (FIG. 8F) and it is dried and baked to form the organic film 41 (FIG. 8G). An ink jet device of the above bubble jet method or the above piezo method is preferably used as the above droplet delivery device.

In the above droplet delivery in the present embodiment, the above droplet can be delivered into the top surface areas of the conductive films 4 by properly controlling the composition of the solution delivered, as in the case of the first embodiment of the above producing method, so that the organic film 41 can also be formed in the top surface areas of the conductive films 4. In the present embodiment, especially, since the surface treatment layer 11 is formed prior to the delivery of droplet, the organic film 41 can be formed without any overhang portion or with overhang portions in a smaller size from the edges of the conductive films 4 on the surface of the substrate, without precisely controlling the composition of the delivered solution.

Namely, the above step in the present embodiment is to make a difference in the wettability between the surface on the conductive film and the other surfaces by first carrying out the surface treatment of the entire surface of the substrate and then depositing the conductive film 4 thereon. On the other hand, when the metal forming the device electrodes 2, 3 is compared with the metal forming the conductive film 4 and when the oxidation-reduction reaction is more active on the metal forming the conductive film 4, a step as described below can also be employed.

First, the conductive metal film is formed at the predetermined position on the substrate 1. Then the fissure is created in the conductive metal film by the forming operation as described above. Then the entire surface is subjected to the surface treatment and thereafter only the conductive metal film is oxidized under such an oxygen atmosphere and temperature as to oxidize only the metal forming the conductive film but not to oxidize the metal forming the electrodes. At this time only the surface treatment film deposited on the conductive metal film is decomposed by oxidation reaction of the base metal. As a result, there appears the difference in wettability between the surface on the conductive film and the other substrate surfaces. When the droplet of the solution containing the above organic material is delivered thereonto, the organic film 41 can be formed without any overhang portion or with overhang portions in a smaller area from the edges of the conductive films 4 on the surface of the substrate 1.

Figure 9:
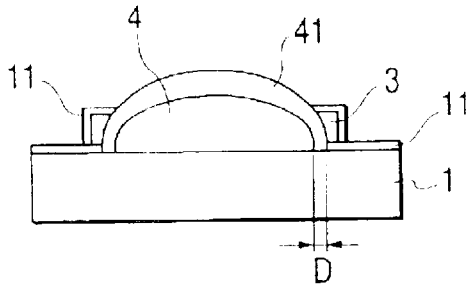
FIG. 9 is a cross-sectional view along 9—9 of FIG. 8G.

In the present embodiment, the maximum size D of the above overhang portions illustrated in FIG. 9, which is a cross-sectional view along 9—9 of FIG. 8G, is 5 $\mu$m in the region on the substrate surface between the electrodes 2, 3.

In the present embodiment a single droplet or a plurality of droplets may be delivered for formation of one organic film. In the case of the single droplet the production time can be decreased as compared with the case of the plural droplets. On the other hand, in the case of the plural droplets, the thickness of the organic film can be controlled by the number of droplets, in addition to the amount of each droplet.

The liquid delivered in the form of the droplet 9 is desirably a solution in which the material for formation of the organic film 41 is dispersed or dissolved in an organic solvent.

The solution desirably has the surface tension at room temperature in the range of 20 to 90 dyne/cm and preferable in the range of 50 to 80 dyne/cm, depending upon the surface treatment method of the surface.

In the present embodiment, since the solution delivered spreads on the conductive films but stops spreading at the outside edges thereof, the organic film will not project off the conductive films, or even with some off the conductive films it can be controlled to the above minimum (D). Therefore, the thickness of the organic film 41 can be controlled readily by the area of the conductive films and the amount of the droplet delivered, which improves repeatability and uniformity of the thickness of the organic film 41.

Since the forming position of the organic film 41 is determined by the position of the conductive films 4, there will occur no influence from slight deviation of the impact point of the droplet from the center of the conductive films, and thus the organic film 41 can be formed at the same position as the conductive films 4.

7) Next, the fissure 7 is also created in the organic film 41 by the energization operation of the conductive films 4, and the organic films 41 are further carbonized near the fissure 7.

Figure 8H:
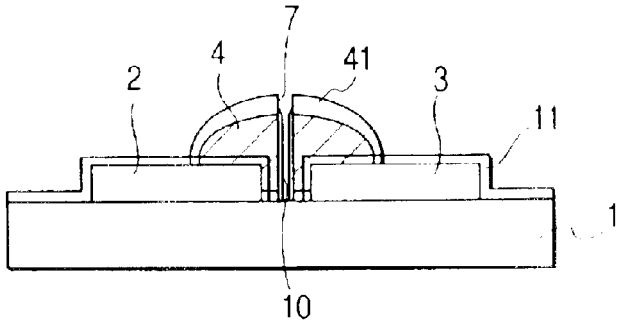

Therefore, the carbon films are formed on the ends of the conductive films 4 facing the fissure 5 of the conductive films 4 (FIG. 8H).

In the second embodiment concerning the producing method described above, the order of the above forming operation step 5) and the step 6) of formation of the organic film may also be reverse, as in the case of the first embodiment described previously.

Namely, the step of forming the organic film 41 on the conductive thin films 4 formed by above step 4), is carried out as a step 5') in the like manner as in above step 6), and thereafter the energization forming operation step, similar to that in above step 5), is carried out as a step 6'). This produces the fissures 5, 7 in both the conductive film 4 and the organic film 41 and in this case the organic films 41 are also carbonized near the fissure 7, whereby the carbon films 10 are formed on the ends of the conductive films 4 facing the fissure 5.

In the present embodiment it is also preferable to carry out the stabilization step further, as in the case of the first embodiment concerning the above producing method.

Next, examples of application of the electron emitting device of the present invention will be described below. For example, the electron source or the image forming apparatus can be constructed by arranging a plurality of electron emitting devices according to the present invention on the substrate.

A variety of array configurations can be employed for the arrangement of electron emitting devices. An example is a ladderlike configuration in which a lot of electron emitting devices arranged in parallel are connected each at the both ends, multiple rows of electron emitting devices are arranged in a direction (called a row direction), and electrons from the electron emitting devices are controlled by a control electrode (also called a grid) disposed in a direction perpendicular to wiring thereof (called a column direction) and above the electron emitting devices. Another example is one in which a plurality of electron emitting devices are arrayed in a matrix pattern along the X-direction and the Y-direction, first electrodes of plural electron emitting devices arrayed in one row are connected to a common wire along the X-direction, and second electrodes of plural electron emitting devices arrayed in one column are connected to a common wire along the Y-direction. This is so called a simple matrix configuration. First, the simple matrix configuration will be detailed below.

The electron emitting device of the present invention has three properties. Namely, the electrons emitted from the surface conduction electron emitting device can be controlled by the peak value and the width of pulsed voltage applied between the opposed device electrodes in the range over a threshold voltage. On the other hand, few electrons are emitted in the range below the threshold voltage. According to this property, in the case of the configuration of many electron emitting devices, it is also possible to select either surface conduction electron emitting device and control an electron emission amount thereof in accordance with an input signal, by suitably applying the pulsed voltage to the individual devices.

Figure 12:
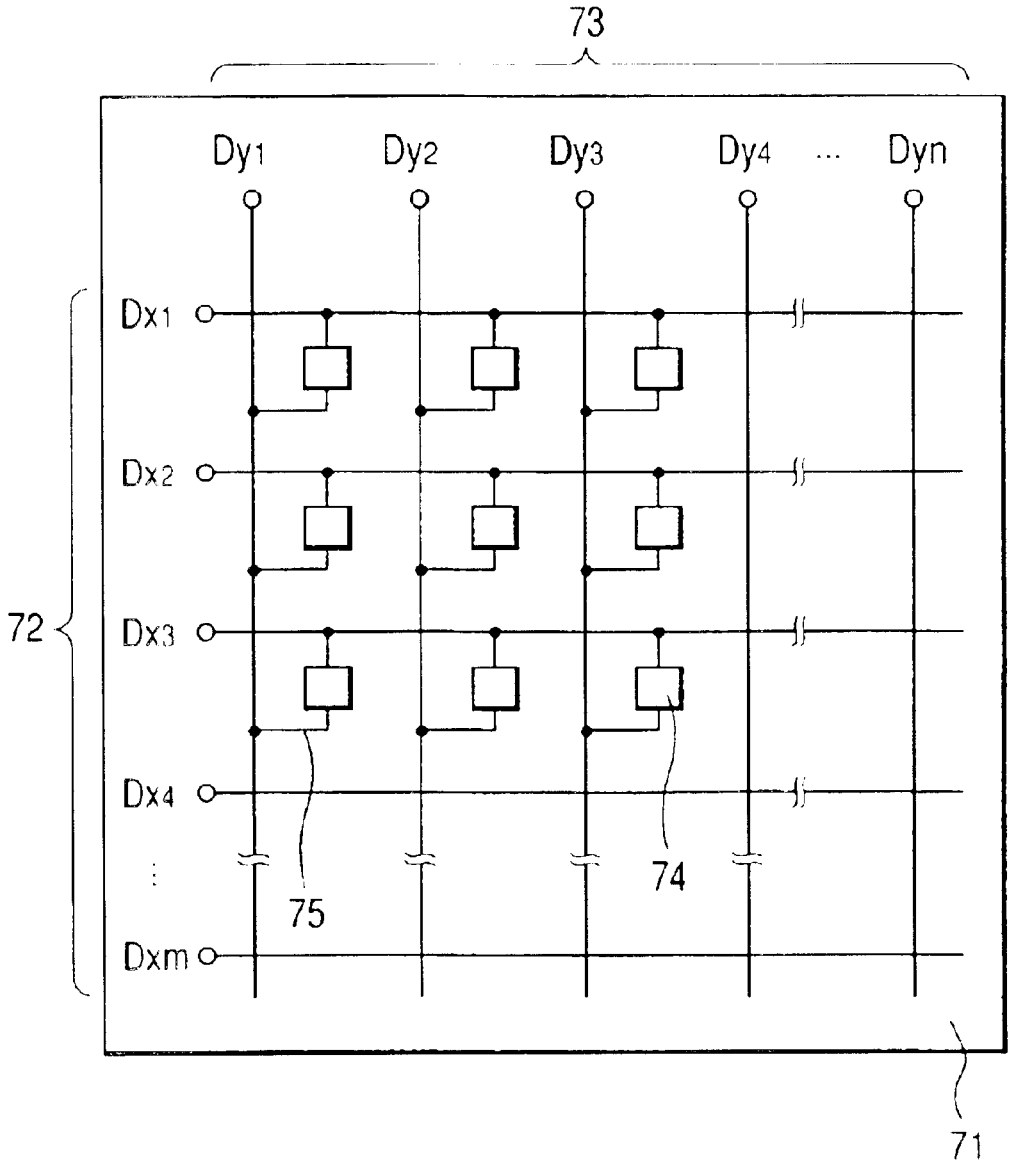
FIG. 12 is a schematic diagram to show an example of an electron source of a simple matrix configuration according to the present invention.

The following will describe an electron source substrate constructed by arranging a plurality of electron emitting devices of the present invention, based on the above principle, by reference to FIG. 12. In FIG. 12, reference numeral 71 designates an electron source substrate, 72 X-directional wires, and 73 Y-directional wires. Numeral 74 denotes electron emitting devices and 75 connection wires.

The m X-directional wires 72 consist of Dx1, Dx2, . . . , Dxm and can be made of conductive metal or the like deposited by vacuum evaporation, printing, sputtering, or the like. The material, the thickness, and the width of the wires are designed as occasion may demand. The Y-directional wires 73 consist of n wires of Dy1, Dy2, . . . , Dyn and are formed as are the X-directional wires 72. An interlayer dielectric film not illustrated is provided between these m X-directional wires 72 and n Y-directional wires 73, so as to separate them electrically from each other (m, n both are positive integers).

The interlayer dielectric film not illustrated is made of $SiO_2$ or the like formed by vacuum evaporation, printing, sputtering, or the like. For example, it is formed in a desired pattern throughout the entire surface or in part of the substrate 71 with the X-directional wires 72 formed thereon and, particularly, the thickness, material, and production process thereof are suitably set so as to be able to resist the potential difference at intersections between the X-directional wires 72 and the Y-directional wires 73. Each of the X-directional wires 72 and the Y-directional wires 73 is drawn out as an external terminal.

A pair of device electrodes (not illustrated) forming each electron emitting device 74 are electrically connected each to either of the m X-directional wires 72 and the n Y-directional wires 73 by connection lines 75 made of the conductive metal or the like.

Some or all of the constituent elements may be common to or different among the material making the wires 72 and wires 73, the material making the connection lines 75 and the material making the pairs of device electrodes. These materials are suitably selected, for example, from the aforementioned materials for the device electrodes. In the case wherein the material making the device electrodes is the same as the wiring material, the wires connected to the device electrodes can also be mentioned as the device electrodes.

The X-directional wires 72 are coupled to an unillustrated scanning signal applying means for applying a scanning signal for selecting a row of electron emitting devices 74 arrayed in the X-direction. On the other hand, the Y-directional wires 73 are coupled to an unillustrated modulation signal generating means for modulating each column of electron emitting devices 74 arrayed in the Y-direction in accordance with an input signal. A driving voltage applied to each electron emitting device is supplied as a difference voltage between a scanning signal and a modulation signal applied to the device of interest.

In the above structure, the individual devices can be selected and driven independently, using the simple matrix wiring.

Figure 13:
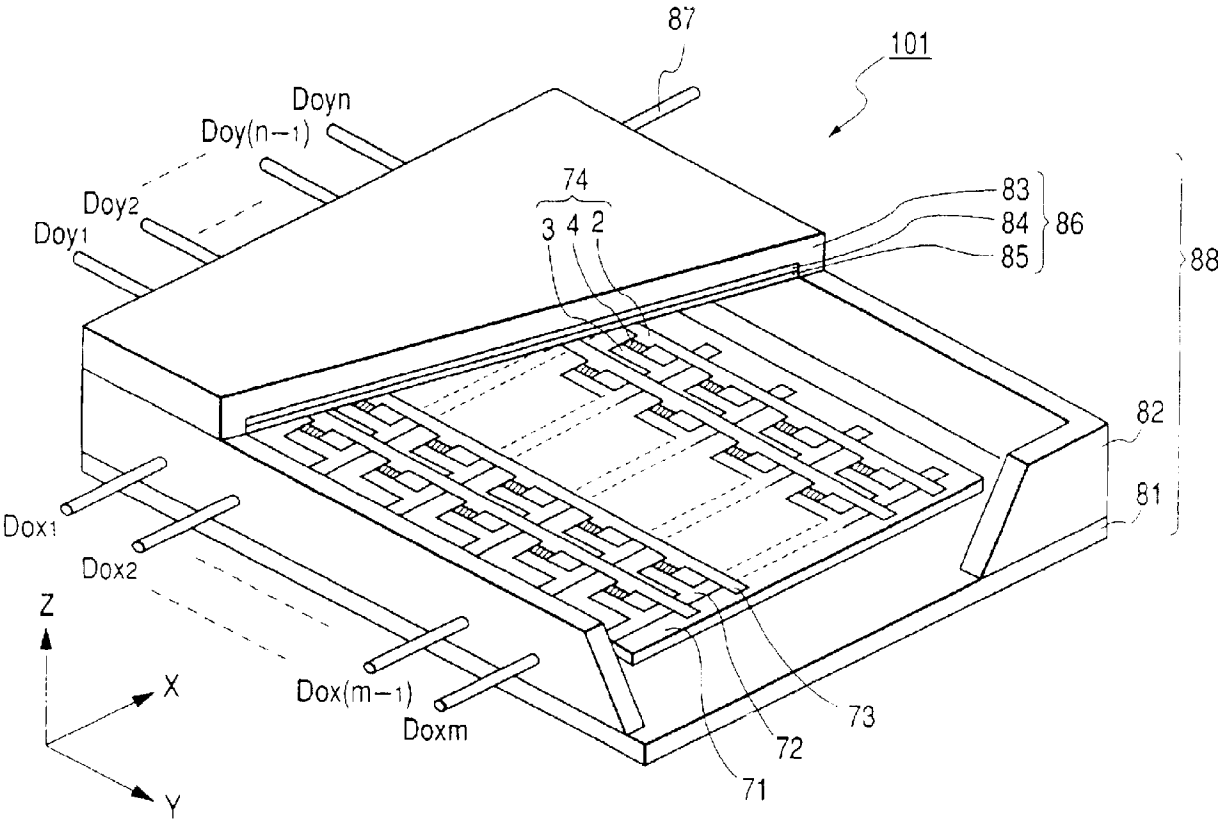
FIG. 13 is a schematic diagram to show an example of a display panel of an image forming apparatus according to the present invention.
Figure 14:
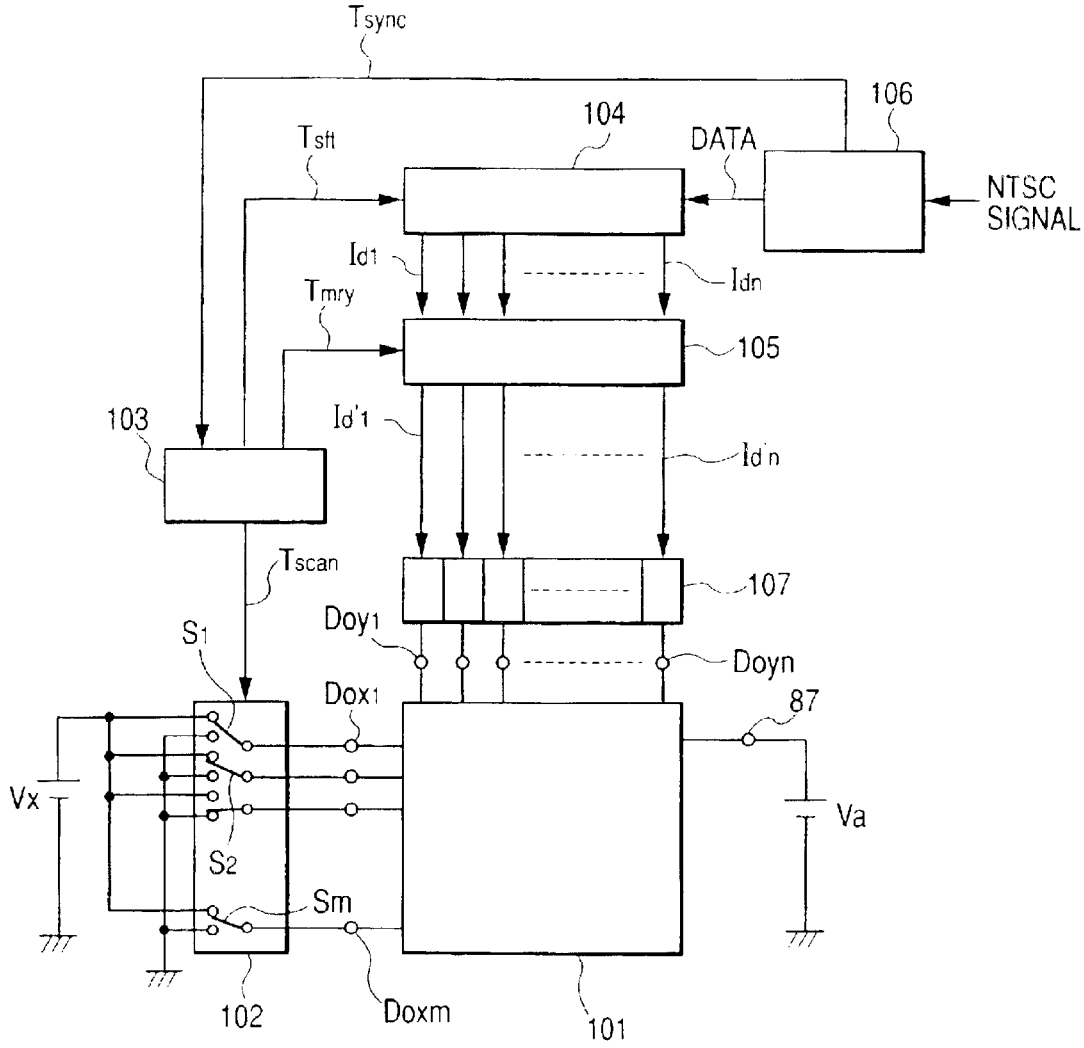
FIG. 14 is a block diagram to show an example of a driving circuit for implementing display according to television signals of the NTSC system in the image forming apparatus according to the present invention.

An image forming apparatus constructed with the electron source of such a simple matrix configuration will be described referring to FIG. 13 and FIG. 14. FIG. 13 is a schematic diagram to show an example of the display panel of the image forming apparatus. FIG. 14 is a block diagram to show an example of the driving circuit for effecting the display according to NTSC television signals.

In FIG. 13, numeral 71 denotes an electron source substrate with a plurality of electron emitting devices thereon, 81 a rear plate to which the electron source substrate 71 is fixed, and 86 a face plate in which a fluorescent film 84, a metal back 85, etc. are formed on an internal surface of a glass substrate 83. Numeral 82 represents a support frame and the rear plate 81 and face plate 86 are coupled to the support frame 82 with frit glass or the like. Numeral 88 denotes an envelope, which is sealed by baking the components in the temperature range of 400 to 500° C. for ten or more minutes, for example, in air or in nitrogen.

Numeral 74 indicates the electron emitting devices as illustrated in FIG. 1A and FIG. 1B or in FIG. 6A to FIG. 6C. Numerals 72 and 73 stand for the X-directional wires and the Y-directional wires coupled to the pairs of device electrodes of the surface conduction electron emitting devices.

The envelope 88 is comprised of the face plate 86, the support frame 82, and the rear plate 81 as described above. Since the rear plate 81 is provided mainly for the purpose of reinforcing the strength of the substrate 71, the separate rear plate 81 can be omitted if the substrate 71 itself has sufficient strength. In that case, the support frame 82 may hermetically be bonded directly to the substrate 71, whereby the envelope 88 can be constructed of the face plate 86, the support frame 82, and the substrate 71. As another example, the envelope 88 can also be constructed with sufficient strength against the atmospheric pressure by mounting an unrepresented support called a spacer between the face plate 86 and the rear plate 81.

Figure 17A:
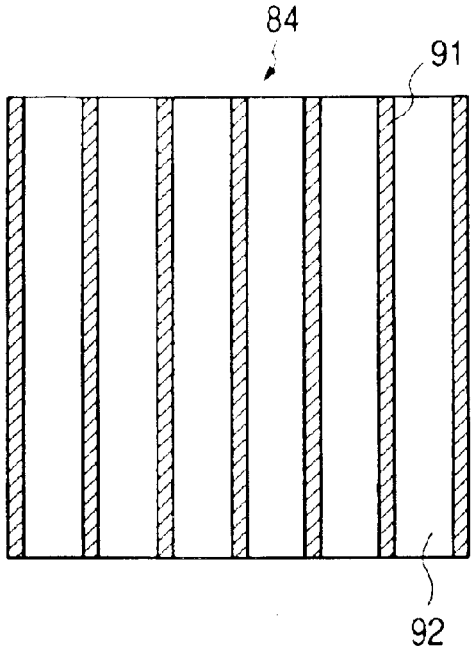
FIG. 17A and FIG. 17B are schematic diagrams each of which shows an example of a fluorescent film in the display panel.
Figure 17B:
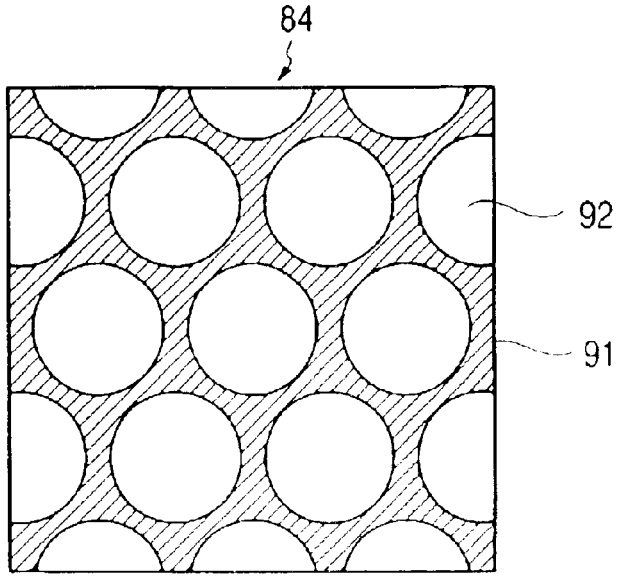

The fluorescent film 84 can be made of only a fluorescent material in the monochrome case. In the case of a color fluorescent film, the fluorescent film can be made of fluorescent materials 92 and a black conductive material 91 called black stripes (FIG. 17A) or a black matrix (FIG. 17B) or the like depending upon the array of the fluorescent materials. Purposes of provision of the black stripes or the black matrix are to make color mixture or the like unobstructive by blacking color-separating portions between the fluorescent materials 92 of the three primary colors necessitated in the case of the color display, and to suppress decrease in contrast due to reflection of ambient light on the fluorescent film 84. A material for the black conductive material 91 can be one selected from materials including the principal component of graphite commonly used; and also from electrically conductive materials with little transmission and little reflection of light.

A method for applying the fluorescent materials to the glass substrate 83 can be selected from a precipitation method, printing, and the like in either of the monochrome case and the color case. The metal back 85 is normally provided on the inner surface of the fluorescent film 84. Purposes of provision of the metal back are to enhance the luminance by specular reflection of light traveling to the inside out of the light emitted from the fluorescent material, toward the face plate 86, to use the metal back as an electrode for applying an electron beam acceleration voltage, to protect the fluorescent material from damage due to collision of negative ions generated in the envelope, and so on. The metal back can be fabricated by carrying out a smoothing operation (normally called "filming") of the inside surface of the fluorescent film and thereafter depositing Al by vacuum evaporation or the like, after production of the fluorescent film.

The face plate 86 may be provided with a transparent electrode (not illustrated) on the outer surface side of the fluorescent film 84 in order to further enhance the electrically conductive property of the fluorescent film 84.

On the occasion of carrying out the aforementioned sealing, sufficient position alignment is essential in the color case in order to match the electron emitting devices with the respective color fluorescent materials.

The image forming apparatus shown in FIG. 13 is produced, for example, in the following manner.

The inside of the envelope 88 is evacuated with suitably being heated through an unillustrated exhaust pipe by an evacuation device using no oil, such as the ion pump, the absorption pump, or the like, up to an atmosphere with a sufficiently reduced amount of organic substances and of the vacuum degree of about $10^{-5}$ Pa, and thereafter the sealing is implemented. A getter operation may also be carried out in order to maintain the vacuum degree after the sealing of the envelope 88. This getter operation is an operation for heating a getter (not illustrated) placed at a predetermined position in the envelope 88 by a heating method such as resistance heating or high-frequency heating to form an evaporated film, immediately before or after execution of the sealing of the envelope 88. The getter normally contains a principal component of Ba or the like, and maintains, for example, the vacuum of $1\times10^{-5}$ Pa or lower by adsorption action of the evaporated film. Here the steps of and after the forming operation of the electron emitting devices can be set as occasion may demand.

Next described referring to FIG. 14 is a structural example of the driving circuit for performing the television display based on TV signals of the NTSC system, on the display panel constructed using the electron source of the simple matrix configuration. In FIG. 14, numeral 101 designates an image display panel, 102 a scanning circuit, 103 a control circuit, 104 a shift register, 105 a line memory, 106 a synchronous signal separator, 107 a modulation signal generator, and Vx and Va dc voltage supplies.

The display panel 101 is connected to the external, electric circuits through the terminals Dox1 to Doxm, the terminals Doy1 to Doyn, and a high-voltage terminal 87. Applied to the terminals Dox1 to Doxm are scanning signals for successively driving the electron source provided in the display panel 101, i.e., the group of electron emitting devices matrix-wired in a matrix of m rows×n columns row by row (every n devices). Applied to the terminals Doy1 to Doyn are modulation signals for controlling an output electron beam from each of electron emitting devices in a row selected by the scanning signal. The dc voltage, for example, of 10 kV is supplied from the dc voltage supply Va to the high-voltage terminal 87, and it is the acceleration voltage for imparting sufficient energy for excitation of the fluorescent material to the electron beams emitted from the electron emitting devices.

The scanning circuit 102 will be described. The circuit is provided with m switching devices inside (which are schematically indicated by S1 to Sm in the drawing). Each switching device selects either the output voltage of the dc voltage supply Vx or 0 [V] (the ground level) to be electrically connected to the terminal Dox1 to Doxm of the display panel 101. Each switching device S1 to Sm operates based on a control signal Tscan outputted from the control circuit 103, and can be constructed of a combination of such switching devices as FETs, for example.

The dc voltage supply Vx in the present example is so set as to output such a constant voltage that the driving voltage applied to the devices not scanned is not more than the electron emission threshold voltage, based on the characteristics (the electron emission threshold voltage) of the electron emitting devices.

The control circuit 103 has the function of matching operations of the respective sections so as to achieve the appropriate display based on the image signals supplied from the outside. The control circuit 103 generates each control signal of Tscan, Tsft, and Tmry to each section, based on a synchronous signal Tsync sent from the synchronous signal separator 106.

The synchronous signal separator 106 is a circuit for separating a synchronous signal component and a luminance signal component from the TV signal of the NTSC system supplied from the outside, which can be constructed using an ordinary frequency separator (filter) circuit or the like. The synchronous signal separated by the synchronous signal separator 106 is composed of a vertical synchronous signal and a horizontal synchronous signal, but it is illustrated as a Tsync signal herein for convenience' sake of description. The luminance signal component of image separated from the aforementioned TV signal is indicated by DATA signal for convenience' sake. The DATA signal is supplied to the shift register 104.

The shift register 104 is a register for performing serial/parallel conversion for each line of image of the aforementioned DATA signal serially inputted in time series, which operates based on the control signal Tsft sent from the control circuit 103 (this means that the control signal Tsft can be said to be a shift clock of the shift register 104).

The data of each line of image after the serial/parallel conversion (corresponding to the driving data for n devices of the electron emitting devices) is outputted as n parallel signals of Id1 to Idn from the shift register 104.

The line memory 105 is a storage device for storing the data of one line of image during a necessary period, which properly stores the data of Id1 to Idn according to the control signal Tmry sent from the control circuit 103. The stored data is outputted as Id'1 to Id'n to the modulation signal generator 107.

The modulation signal generator 107 is a signal source for properly driving and modulating each of the electron emitting devices according to each of the image data Id'1 to Id'n, and output signals therefrom are applied through the terminals Doy1 to Doyn to the electron emitting devices in the display panel 101.

As described previously, the electron emitting devices of the present invention have the following fundamental characteristics concerning the emission current Ie. Specifically, there is the definite threshold voltage Vth for electron emission, so that electron emission occurs only upon application of the voltage over Vth. With voltages over the electron emission threshold voltage, the emission current also varies according to change in the voltage applied to the device. It is seen from this fact that when pulses of the voltage are applied to the present devices, no electron emission occurs with application of the voltage below the electron emission threshold voltage, but the electron beams are outputted with application of the voltage over the electron emission threshold, for example. On that occasion, the intensity of output electron beam can be controlled by changing the peak value Vm of the pulses. It is also possible to control a total amount of charge of the output electron beam by changing the width Pw of the pulses.

Accordingly, the voltage modulation method, the pulse width modulation method, or the like can be employed as a method for modulating the electron emitting devices according to the input signal. For carrying out the voltage modulation method, the modulation signal generator 107 can be a circuit of the voltage modulation method for generating voltage pulses of a constant length and properly modulating peak values of the pulses according to the input data. For carrying out the pulse width modulation method, the modulation signal generator 107 can be a circuit of the pulse width modulation method for generating voltage pulses of a constant peak value and properly modulating widths of the voltage pulses according to the input data.

The shift register 104 and the line memory 105 can be of either the digital signal type or the analog signal type. The point is that the serial/parallel conversion and storage of image signal should be carried out at a predetermined rate.

For use of the digital signal type, the output signal DATA of the synchronous signal separator 106 needs to be digitized. For this purpose, the output section of the synchronous signal separator 106 is provided with an A/D converter. In connection with it, the circuit used in the modulation signal generator 107 will slightly differ depending upon whether the output signals of the line memory 105 are digital signals or analog signals. In the case of the voltage modulation method using digital signals, the modulation signal generator 107 is, for example, a D/A converter and an amplifier or the like is added if necessary. In the case of the pulse width modulation method, the modulation signal generator 107 is a circuit, for example, comprised of a combination of a high-speed oscillator, a counting device (counter) for counting waves outputted from the oscillator, and a comparator for comparing an output value of the counter with an output value of the memory. The circuit may also be provided with an amplifier for amplifying the voltage of the modulation signal modulated in the pulse width from the comparator to the driving voltage of the electron emitting devices, if necessary.

In the case of the voltage modulation method using analog signals, the modulation signal generator 107 can be an amplifying circuit, for example, using an operational amplifier and may also be provided with a level shift circuit or the like if necessary. In the case of the pulse width modulation method, a voltage-controlled oscillator (VCO) can be employed, for example, and it can also be provided with an amplifier for amplifying the voltage to the driving voltage of the electron emitting devices, if necessary.

In the image forming apparatus of the present invention which can be constructed as described above, electron emission occurs when the voltage is applied through the external terminals Dox1 to Doxm, Doy1 to Doyn outside the container to each electron emitting device. The electron beams are accelerated by applying the high voltage through the high-voltage terminal 87 to the metal back 85 or to a transparent electrode (not illustrated). The electrons thus accelerated collide with the fluorescent film 84 to bring about luminescence, thus forming the image.

It should be noted that the structure of the image forming apparatus stated herein is just an example of the image forming apparatus of the present invention, and it can involve a variety of modifications based on the technological thought of the present invention. Although the NTSC system was exemplified for the input signals, the input signals can be of the PAL system, the SECAM system, or the like, or any system of TV signals including more scanning lines (for example, one of high-definition TV systems including the MUSE system) without having to be limited to the NTSC system.

Next, the electron source and image forming apparatus of the aforementioned ladder type configuration will be described referring to FIG. 15 and FIG. 16.

Figure 15:
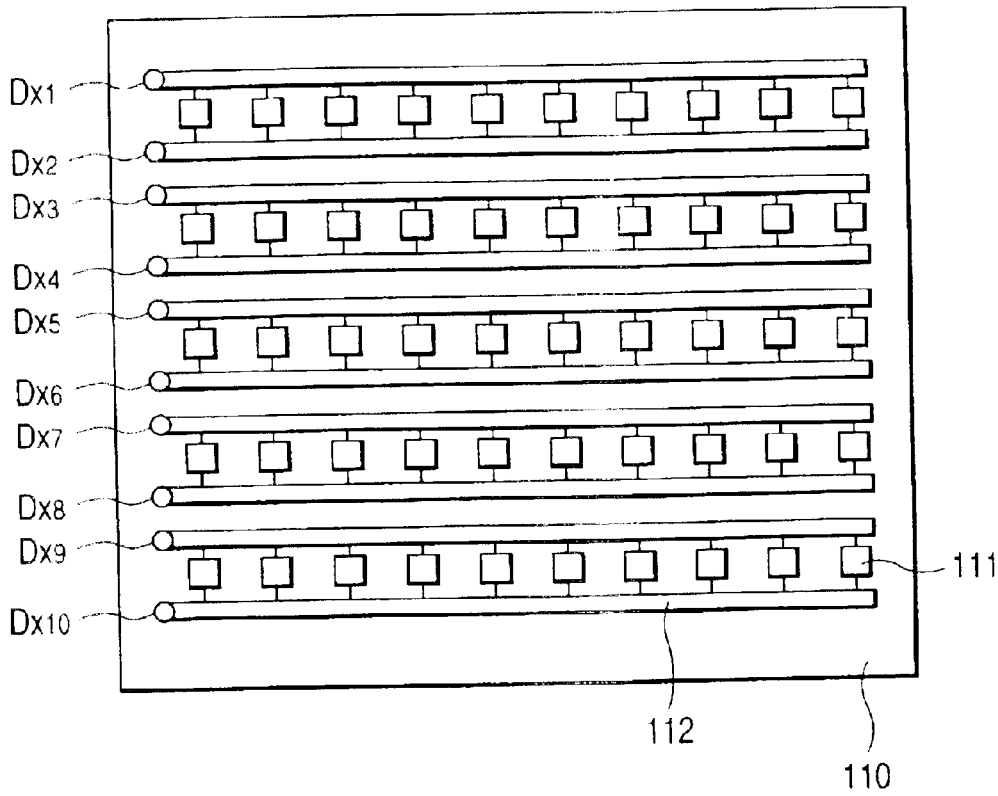
FIG. 15 is a schematic diagram to show an example of an electron source of a ladder type configuration according to the present invention.

FIG. 15 is a schematic diagram to show an example of the electron source of the ladder type configuration. In FIG. 15, numeral 110 represents the electron source substrate and 111 the electron emitting devices. Numeral 112 denotes common wires Dx1 to Dx10 for connecting the electron emitting devices 111, which are drawn out as external terminals. A plurality of electron emitting devices 111 are arranged in parallel in the X-direction (which will be called device rows) on the substrate 110. A plurality of device rows are placed to compose an electron source. Each device row can be driven independently by applying a driving voltage between the common wires of each device row. Specifically, a voltage exceeding the electron emission threshold is applied to a device row expected to emit the electron beams, whereas a voltage below the electron emission threshold is applied to a device row not expected to emit the electron beams. The common wires Dx2 to Dx9 located between the device rows can be integral wires; for example, each pair of Dx2 and Dx3, Dx4 and Dx5, Dx6 and Dx7, and Dx8 and Dx9 can be constructed of a single wire.

Figure 16:
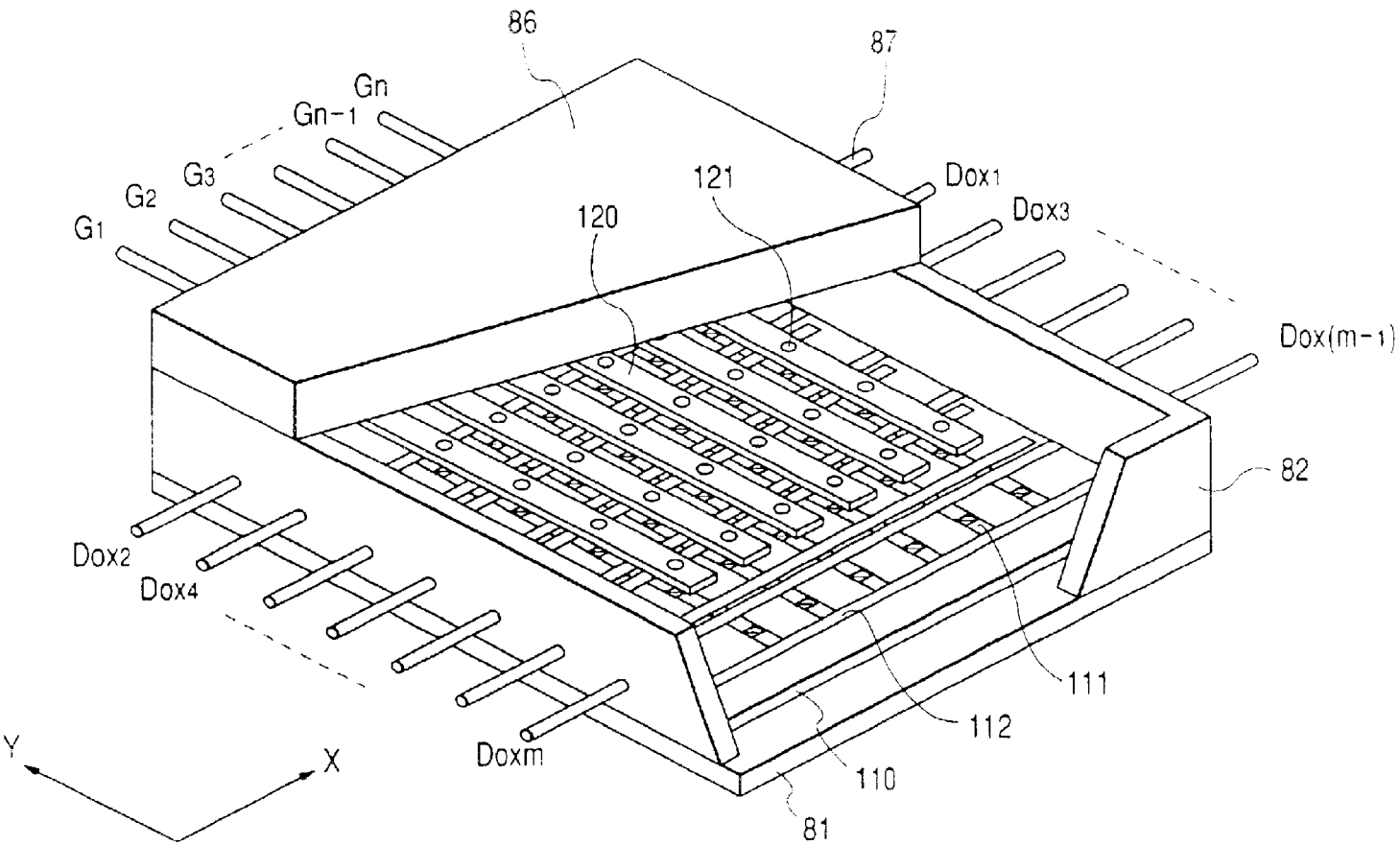
FIG. 16 is a schematic diagram to show another example of the display panel of the image forming apparatus according to the present invention.

FIG. 16 is a schematic diagram to show an example of the panel structure in the image forming apparatus provided with the electron source of the ladder type configuration. Numeral 120 designates a grid electrode, 121 openings through which electrons pass, Dox1 to Doxm terminals outside the vessel, and G1 to Gn external terminals connected to the grid electrode 120. Numeral 110 denotes the electron source substrate where the common wires between the device rows are integral wires. In FIG. 15 the same portions as those in FIG. 12 and FIG. 13 are denoted by the same reference symbols as those in these figures. A significant difference between the image forming apparatus shown herein and the image forming apparatus of the simple matrix configuration shown in FIG. 12 is whether or not the grid electrode 120 is provided between the electron source substrate 110 and the face plate 86.

In FIG. 16, there is the grid electrode 120 provided between the substrate 110 and the face plate 86. The grid electrode 120 is provided for modulating the electron beams emitted from the electron emitting devices 111 and is provided with the circular apertures 121, one each per device, for allowing the electron beams to pass toward the electrodes of the stripe pattern provided perpendicular to the device rows of the ladder type configuration. The shape and placement position of the grid electrode are not limited to those shown in FIG. 15. For example, the apertures may be passing pores of a mesh pattern, and the grid electrode can also be located around or near the electron emitting devices.

The external terminals Dox1 to Doxm and the grid external terminals G1 to Gn outside the vessel are electrically connected to a control circuit not illustrated.

In the image forming apparatus of the present example, modulation signals for one line of image are simultaneously applied to each grid electrode column in synchronism with successive driving (scanning) of the device rows row by row. This permits control of radiation of each electron beam to the fluorescent material, whereby an image can be displayed line by line.

The image forming apparatus of the present invention described above can be applied to the display devices for television broadcasting system, the display devices for television conference systems, computers, and so on, the image forming apparatus as an optical printer constructed using a photosensitive drum etc., and so on.

EXAMPLES

Preferred examples of the present invention will be explained below, but it is noted that the present invention is by no means intended to be limited to the following examples.

Example 1

In the present example the surface conduction electron emitting device of the type illustrated in aforementioned FIG. 1A and FIG. 1B was produced.

The producing method of the surface conduction electron emitting device in the present example will be described, using FIG. 2A to FIG. 2D and FIG. 3E to FIG. 3G.

The insulating substrate 1 used herein was one obtained by depositing SiOx of 0.5 μm on a cleaned glass substrate by CVD, it was cleaned well with an organic solvent, and thereafter the device electrodes 2, 3 of platinum were formed on the surface of the substrate 1 (FIG. 2A). At this time, the spacing L between the device electrodes (FIG. 1A and FIG. 1B) was 10 μm, the width W of the device electrodes (FIG. 1A and FIG. 1B) was 500 μm, and the thickness thereof was 100 μm. Next, weighing 0.6 g of palladium acetate-tetraethanolamine complex $[Pd(H_2NC_2H_4OH)_4\ (CH_3COO)_2]$, 0.05 g of 86% saponification polyvinyl alcohol (the degree of average molecular weight: 500), 25 g of isopropyl alcohol, and 1 g ethylene glycol, water was added thereto up to the total amount of 100 g, thus preparing a palladium compound solution.

This palladium compound solution was filtered by a membrane filter having the pore size of 0.25 μm and then it was charged into a bubble jet head BC-01 available from CANON Inc. The dc voltage of 20 V was applied for 7 μsec from the outside to the predetermined heater inside the head, whereby the droplet 9 of the palladium compound solution was delivered onto the gap part of the device electrodes 2, 3 on the above insulating substrate 1 (FIG. 2B). While maintaining the positions of the head 8 and the substrate 1, the delivery operation was repeated five more times. The liquid drop became almost circular on the surface of the substrate 1 and the diameter thereof was about 110 μm. This substrate 1 was heated in an oven of the air atmosphere and at 350° C. for 30 minutes to allow the aforementioned metal compound to be decomposed and deposited on the substrate 1, whereby the conductive film 4 of palladium oxide was formed in the nearly circular shape (FIG. 2C). The diameter of this conductive film of palladium oxide (the dot diameter) was about 110 μm.

Next, the voltage was applied between the device electrodes 2 and 3 to effect the energization operation (the forming operation) of the conductive film 4, thereby forming the fissure 5 in the conductive film 4 (FIG. 2D).

The voltage waveform of the forming operation in the present example is illustrated in FIG. 4B. In FIG. 4B, T1 and T2 are the pulse width and the pulse separation of the voltage waveform, and in the present example T1 was 1 msec, T2 was 10 msec, the peak values of the triangular waves (peak voltages upon forming) were 5 V, and the forming operation was carried out for 60 seconds under a vacuum atmosphere of about $1\times10^{-6}$ Pa.

Then an N-methylpyrrolidone solution of polyamic acid 2% and triethanolamine 5% was charged into a piezo head of the ink jet method, the piezo head was aligned with the center of the conductive films 4 of palladium oxide of the above circular shape, two droplets of the solution were delivered from the piezo head by applying the triangular waves of 25 V thereto, and the substrate was baked at 350° C. for 30 minutes, whereby the organic film 6 of polyimide was formed in a nearly circular shape only on the aforementioned palladium oxide film. The diameter of this organic film of polyimide (the dot diameter) was about 80 μm (FIG. 3E).

Next, the voltage of the bipolar pulse waveform was applied between the device electrodes 2, 3. Voltage values were gradually increased from 2.0 V and the application of voltage was stopped around 14 to 18 V, because high resistance was demonstrated thereat. Observation with a scanning electron microscope (SEM) at that time verified that the fissure 7 was created in the organic film 6 of polyimide along the fissure 5 of the conductive films 4 of palladium oxide created by the forming operation. The organic films 6 were also carbonized near the fissure 7 and thus the carbon films 10 were formed on the ends of the conductive films 4 facing the fissure 5 (FIG. 3F).

Figure 5:
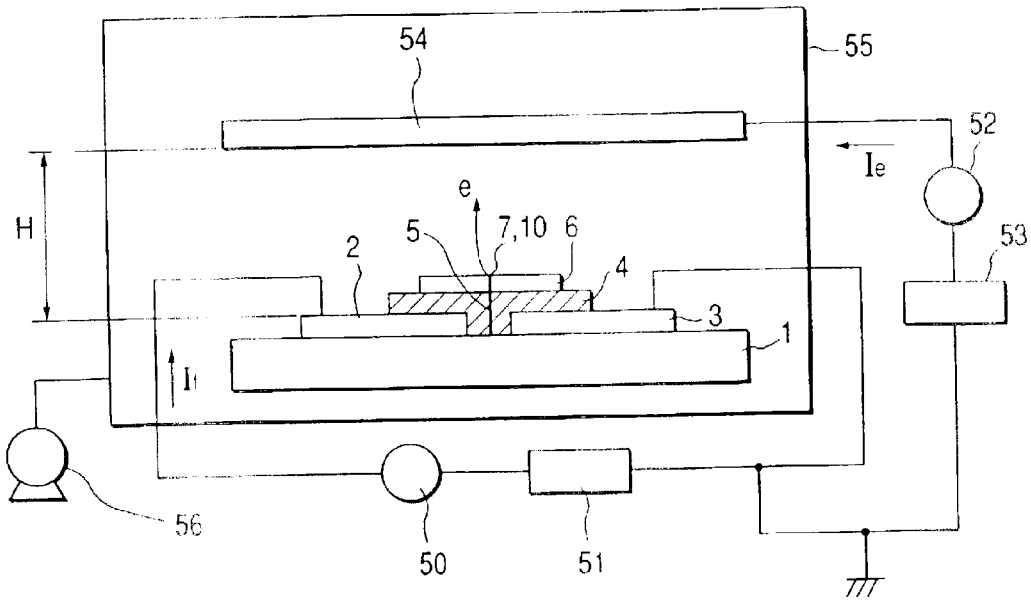
FIG. 5 is a schematic diagram to show an example of a vacuum process system provided with measurement and evaluation function.

The electron emitting device produced as described above was subjected to the measurement of the electron emission characteristics. FIG. 5 is a schematic structural diagram of a measurement-evaluation system for the electron emission characteristics prepared.

In FIG. 5, 1 to 8 indicate the above-stated electron emitting device produced in the present example, 51 a power supply for applying the voltage between the device electrodes 2, 3, 50 a current meter for measuring the device current If, 54 an anode electrode for measuring the emission current Ie from the electron emitting device, 53 a high voltage supply for applying the voltage to the anode electrode 54, and 52 a current meter for measuring the emission current.

For measuring the above device current If and emission current Ie of the electron emitting device, the power supply 51 and current meter 50 are connected to the device electrodes 2, 3 and the anode electrode 54 connected to the power supply 53 and current meter 52 is placed above the electron emitting device. The electron emitting device and anode electrode 54 are set inside a vacuum chamber 55, and the vacuum chamber is equipped with devices necessary for the vacuum chamber, such as an evacuation pump 56, an unrepresented vacuum meter, etc., so as to be able to measure and evaluate the electron emitting device under a desired vacuum.

In the present example, the distance H between the anode electrode and the electron emitting device was 4 mm, the potential of the anode electrode was 1 kV, and the pressure inside the vacuum chamber upon the measurement of the electron emission characteristics was $1\times10^{-6}$ Pa.

With the measurement-evaluation system as described above, when the device voltage 25 V was applied between the electrodes 2 and 3 of the electron emitting device produced in the present example, the device current If was 0.4 mA and the emission current Ie was 3.8 μA. With the electron emitting device produced in the present example, no ohmic current flowed, the device current If was small, and a ratio of the emission current Ie to the device current If, (Ie/If), was large.

Next, instead of the anode electrode 54, the face plate having the fluorescent film and the metal back described previously was placed inside the vacuum chamber. Under this setting the characteristics of the electron emitting device produced in the present example were evaluated.

Further, a plurality of electron emitting devices were formed flatly on the x-y axes to form an electron source and an attempt was made to effect emission of electrons from the electron source. In this attempt part of the fluorescent film emitted light. This proved that the electron emitting device and the electron source produced in the present example functioned as a light-emitting display element.

Example 2

In the present example the surface conduction electron emitting device illustrated in FIG. 1A and FIG. 1B was produced in the same manner as in Example 1 except that the organic film 6 in Example 1 was formed using a composition of the N-methylpyrrolidone (NMP) solution of polyamic acid 2% and triethanolamine 2%. In the present example the organic film 6 of polyimide was also formed in the nearly circular shape only on the conductive films 4 described in Example 1 and the diameter of this polyimide film (the dot diameter) in the present example was about 87 μm.

The electron emitting device produced in the present example was also one having the characteristics and function similar to those in Example 1.

Example 3

In the present example the surface conduction electron emitting device illustrated in FIG. 1A and FIG. 1B was produced in the same manner as in Example 1 except that the organic film 6 in Example 1 was formed using a composition of the N-methylpyrrolidone (NMP) solution of polyamic acid 2% and triethanolamine 10%. In the present example the organic film 6 of polyimide was also formed in the nearly circular shape only on the conductive films 4 described in Example 1 and the diameter of this polyimide film (the dot diameter) in the present example was about 77 μm.

The electron emitting device produced in the present example was also one having the characteristics and function similar to those in Example 1.

Example 4

The present example below is an example in which the aforementioned energization forming operation for forming the fissure in the conductive film is carried out after formation of the organic film on the conductive film. The present example will be described below using FIG. 1A, FIG. 1B, FIG. 2A to FIG. 2D, and FIG. 3E to FIG. 3G as was Example 1.

The insulating substrate 1 used herein was one obtained by depositing SiOx of 0.5 μm on a cleaned glass substrate by CVD, it was cleaned well with an organic solvent, and thereafter the device electrodes 2, 3 of platinum were formed on the surface of the substrate 1 (FIG. 2A). At this time, the spacing L between the device electrodes (FIG. 1A and FIG. 1B) was 10 μm, the width W of the device electrodes (FIG. 1A and FIG. 1B) was 500 μm, and the thickness thereof was 100 μm. Next, weighing 0.6 g of palladium acetate-tetraethanolamine complex $[Pd(H_2NC_2H_4OH)_4(CH_3COO)_2]$, 0.05 g of 86% saponification polyvinyl alcohol (the degree of average molecular weight: 500), 25 g of isopropyl alcohol, and 1 g ethylene glycol, water was added thereto up to the total amount of 100 g, thus preparing the palladium compound solution.

This palladium compound solution was filtered by the membrane filter having the pore size of 0.25 μm and then it was charged into the bubble jet head BC-01 available from CANON Inc. The dc voltage of 20 V was applied for 7 μsec from the outside to the predetermined heater inside the head, whereby the droplet 9 of the palladium compound solution was delivered onto the gap part of the device electrodes 2, 3 on the above insulating substrate 1 (FIG. 2B). While maintaining the positions of the head 8 and the substrate 1, the delivery operation was repeated five more times. The liquid drop became almost circular and the diameter thereof was about 110 μm. This substrate 1 was heated in the oven of the air atmosphere and at 350° C. for 30 minutes to allow the aforementioned metal compound to be decomposed and deposited on the substrate 1, whereby the conductive film 4 of palladium oxide was formed in the nearly circular shape. The diameter of this conductive film of palladium oxide (the dot diameter) was about 110 μm (FIG. 2C).

Figure 3G:
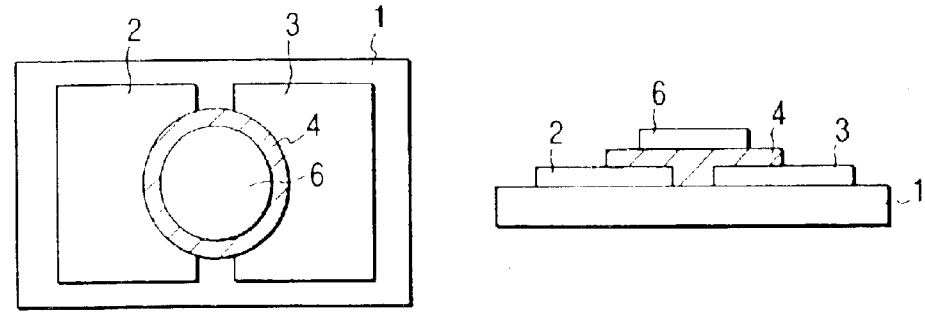

Then the N-methylpyrrolidone solution of polyamic acid 2% and triethanolamine 5% was charged into the piezo head, the piezo head was aligned with the center of the conductive film 4 of palladium oxide of the above circular shape, two droplets of the above solution were delivered thereonto from the head with application of triangular waves of 25 V, and the substrate was baked at 350° C. for 30 minutes, whereby the organic film 6 of polyimide was formed in a nearly circular shape only on the above conductive film 4 of palladium oxide. The diameter of this organic film 6 of polyimide (the dot diameter) was about 80 μm (FIG. 3G).

Next, the voltage was applied between the device electrodes 2, 3 to effect the energization operation (forming operation) of the conductive film 4 with the organic film 6 of polyimide formed thereon. The voltage waveform of the forming operation is illustrated in FIG. 4B.

In FIG. 4B, T1 and T2 are the pulse width and pulse separation of the voltage waveform, and in the present example T1 was 1 msec, Ts was 10 msec, the peak values of triangular waves (peak voltages upon forming) were 8 V to 16 V, and the forming operation was carried out under the vacuum atmosphere of about $1\times10^{-6}$ Pa. Observation with the scanning electron microscope (SEM) at this time verified that the forming operation created the fissures 5, 7 both in the conductive film 4 of palladium oxide and in the organic film 6 of polyimide. The organic films 6 were carbonized near the fissure 7 and thus the carbon films 10 were formed on the ends of the conductive films 4 facing the fissure 5 (FIG. 3F).

The electron emitting device of the present example produced as described above was subjected to the measurement of the electron emission characteristics. The electron emission characteristics were measured using the measurement-evaluation system illustrated in FIG. 5 as in the case of Example 1.

The measurement conditions in the present example were similar to those in Example 1; the distance H between the anode electrode and the electron emitting device was 4 mm, the potential of the anode electrode was 1 kV, and the pressure was $1\times10^{-6}$ Pa in the vacuum chamber upon the measurement of the electron emission characteristics.

When the device voltage Vf of 25 V was applied between the electrodes 2 and 3 of the electron emitting device produced in the present example by use of the measurement-evaluation system as described above, the device current If was 0.45 mA and the emission current Ie was 3.7 μA.

With the electron emitting device produced in the present example, no ohmic current flowed, the device current If was small, and the ratio of the emission current Ie to the device current If, (Ie/If), was large, too.

The face plate having the fluorescent film and metal back described previously was placed instead of the anode electrode 54 inside the vacuum chamber. In this state the attempt was made to effect emission of electrons from the electron source and part of the fluorescent film emitted light. This proved that the electron emitting device produced in the present example functioned as a light-emitting display element.

Example 5

The present example is an example of the image forming apparatus produced using the electron source in which a lot of surface conduction electron emitting devices 74 are matrix-wired by a plurality of X-directional wires 72 and a plurality of Y-directional wires 73, as illustrated in FIG. 12 and FIG. 13.

First, the insulating substrate 71 used herein was a substrate (20 cm×20 cm) formed by depositing SiOx of 0.5 μm on a cleaned glass substrate by CVD, this was cleaned well with an organic solvent, thereafter plural pairs of device electrodes 2, 3 of platinum were formed on the surface of the substrate 71, and then the plural X-directional wires 72 and plural Y-directional wires 73 of Ag were formed, thereby matrix-wiring the above device electrode pairs. An insulating layer, not illustrated, was formed at intersections between the X-directional wires 72 and the Y-directional wires 73. Thereafter, a plurality of surface conduction electron emitting devices were produced in the same manner as in Example 1.

First, droplets of the organometallic compound solution, which was similar to that used in Example 1, were delivered to between each pair of device electrodes 2, 3 formed above, by the ink jet device of the bubble jet method, and were baked to form the conductive films 4 of palladium oxide in a nearly circular shape (FIG. 2C). The diameter of each conductive film (the dot diameter) was about 110 μm. Next, the fissure 5 was created in each conductive film 4 by the forming operation of each conductive film 4 (FIG. 2D). Subsequent to it, the N-methylpyrrolidone solution of polyamic acid 2% and triethanolamine 5% was charged into the piezo head, the piezo head was aligned with the center of each conductive film 4 of palladium oxide of the circular shape, triangular waves of 25 V were applied to the head to deliver two droplets of the solution each onto the conductive films 4, and the substrate was baked at 350° C. for 30 minutes, whereby the organic film 6 of polyimide was formed in a nearly circular shape and in the diameter (dot diameter) of about 80 μm only on each conductive film 4 (FIG. 3E).

Next, the voltage was applied between the device electrodes 2, 3 under the voltage application conditions similar to those in Example 1, whereupon the fissure 7 was created in each organic film 6 of polyimide along the fissure 5 of the conductive films 4 of palladium oxide created by the above forming operation. The organic films 6 were carbonized near each fissure 7 and thus the carbon films 10 were formed on the ends of the conductive films 4 facing the fissure 5 (FIG. 3F).

As illustrated in FIG. 13, the rear plate 81, support frame 82 and face plate 86 were coupled to this electron source substrate 71 and they were sealed under vacuum, thereby producing the image forming apparatus having the driving circuit according to the conceptual diagram of FIG. 14 described previously. Predetermined voltages were applied in time division to the respective electron emitting devices via the terminals Dox1 to Doxm and the terminals Dyo1 to Doyn, and the high voltage was applied to the metal back 85 via the terminal 87, whereupon the image forming apparatus was able to display arbitrary matrix image patterns with uniform quality of image.

In FIG. 13, on the side of the rear plate 81 there are the electron source substrate 71, and the X-directional wires 72, Y-directional wires 73, and electron emitting devices 74 formed at the respective intersections between the X-directional wires 72 and the Y-directional wires 73 on the substrate 71, and on the side of the face plate 86 there are the transparent glass substrate 82, the fluorescent film 84, the metal back 85, and the high-voltage terminal 87 for supplying the high voltage to the metal back 85. The rear plate 81, support frame 82, and face plate 86 are bonded to each other with frit glass, so that the inside is hermetically sealed under a high vacuum.

In the above structure, 5 kV to ten and several kV was applied to the high-voltage terminal 87 and image signals and scan signals were supplied to the terminals Dox1 to Doxm and to the terminals Doy1 to Doyn, whereupon electrons were emitted from the electron source with the lot of electron emitting devices formed thereon to irradiate the fluorescent film. When the fluorescent film was observed from the side of the face plate 86, a sharp image was able to be recognized visually with high luminance.

According to the above examples, the polyimide film can be formed only on the conductive films by applying the viscous solution containing polyamic acid of the precursor of polyimide in the concentration range of 2% to 4%, as the material for formation of the organic film, onto the conductive films formed on the substrate by the ink jet method. The above examples can also provide the electron emitting devices and the producing methods of the electron emitting device with good efficiency and with good uniformity, without flow of the ohmic current except for the current associated with the emission current, due to the part becoming conductive upon formation of the fissure by the energization operation of the polyimide film.

Further, the polyimide film can be formed only on the conductive film by adding the organic amine to polyamic acid, whereby the electron emitting device and the producing method of the electron emitting device can be provided with good uniformity.

Since the constant amount of the organic film material can be delivered only onto the conductive film by the ink jet method, the electron emitting device can be produced easily and the organic film is placed only on the conductive film of the electron emitting device; therefore, it can prevent the formation of electric leak paths due to the carbonization of the organic film during driving and during production, which originates in the organic film formed on the conductive film, the electron emitting device can be formed with high electron emission efficiency and with a long life, and the image forming apparatus with uniform image quality can be produced over a large area easily and at low cost.

Example 6

The basic structure of the surface conduction electron emitting device according to the present example is similar to that in FIG. 6A to FIG. 6C.

The producing method of the surface conduction electron emitting device in the present example is basically similar to that in FIG. 7A to FIG. 7E and FIG. 8F to FIG. 8H. The producing method of the surface conduction electron emitting device in the present example will be described in order, using FIG. 6A to FIG. 6C, FIG. 7A to FIG. 7E and FIG. 8F to FIG. 8H.

Step-a

A mask pattern of a photoresist (RD-2000N-41 available from Hitachi Kasei K.K.) having opening portions corresponding to the device electrode pattern was formed on the substrate 1 of soda lime glass, and a film of Pt was deposited in the thickness of 500 Å by sputtering. Then it was dissolved with a photoresist organic solvent and the Pt deposited film was lifted off, thereby forming the device electrodes 2, 3 (FIG. 7A). The spacing L between the device electrodes (FIG. 6A to FIG. 6C) was 10 μm.

Step-b

The substrate 1 with the device electrodes 2, 3 formed thereon was cleaned well and thereafter the surface of the substrate 1 was exposed to vapor of dimethylmethoxysilane under heating at 60° C. to deposit dimethyldimethoxysilane in the vapor phase, thereby surface-treating the entire surface of the substrate 1 (FIG. 7B). In FIG. 7A to FIG. 7E, numeral 11 designates the surface treatment layer.

Step-c

Using the ink jet device 8 of the ink jet method, four droplets of the palladium compound solution, which was prepared by weighing 0.6 g of the palladium acetate-tetraethanolamine complex, 0.05 g of 86% saponification polyvinyl alcohol, 25 g of isopropyl alcohol, and 1 g of ethylene glycol and adding water thereto up to the total amount of 100 g, were delivered to between the device electrodes 2, 3 of the surface-treated substrate 1 (FIG. 7C). The droplets 9 delivered at this time expanded up to the diameter of 100 μm on the surface of the substrate 1, thereby forming a circular dot.

Step-d

After the delivery of droplets, the substrate was heated at 300° C. for two hours to form the conductive film 4 of fine particles of palladium oxide (FIG. 7D). The conductive film 4 of palladium oxide had the nearly circular shape and the diameter (dot diameter) thereof was 100 μm.

Step-e

Next, the energization forming was carried out by applying the voltage between the device electrodes 2, 3 under the vacuum of $1.3\times10^{-4}$ Pa, thereby forming the fissure 5 in the conductive film 4 (FIG. 7E). The voltage waveform of the energization forming was the one illustrated in FIG. 4B, the pulse width T1 was 0.1 msec, the pulse separation T2 was 25 msec, and the peak voltages were 0 to 18 V.

Step-f

Then three droplets 9' of an N-methylpyrrolidone solution of polyamic acid 0.8% as a precursor of polyimide were delivered onto the conductive films 4 of fine particles of palladium oxide by use of the ink jet device 8 of the ink jet method (FIG. 8F). The solution spread on the conductive films 4 and stopped at the outer edges thereof.

Step-g

Then the substrate was baked at 350° C. in the atmosphere for 30 minutes to form the organic film 41 of polyimide on the conductive films 4 (FIG. 8G). The organic film 41 thus formed had the nearly circular shape and the maximum overhang portion D of the organic film 41 from the edges of the conductive films 4 on the substrate 1, which is illustrated in FIG. 9, was 5 μm in the region between the device electrodes 2, 3. FIG. 9 is a cross-sectional view along 9—9 of FIG. 8G.

Step-h

Next, after evacuation to the vacuum of not more than $1.3\times10^{-5}$ Pa, the driving voltages from 0 to 25 V were applied to effect the carbonization operation. The voltage pulses applied during the carbonization step were similar to those applied during the forming.

The above step created the fissure 7 in the organic film 41 of polyimide along the fissure 5 of the conductive films 4 of palladium oxide created by the above forming operation, the organic films 41 were carbonized near the fissure 7, and thus the carbon films 10 were formed on the ends of the conductive films 4 facing the fissure 5 (FIG. 8H).

The electron emitting device produced as described above was subjected to the measurement of the electron emission characteristics after evacuation to the vacuum of $1.3\times10^{-5}$ Pa, using the measurement system illustrated in FIG. 5 and applying the driving voltage of 25 V and the anode voltage of 1 kV. Then the leak current was absent, the device current If=0.5 mA, the emission current Ie=5.0 μA, and thus the good electron emission characteristics were demonstrated.

Comparative Example 1

The surface conduction electron emitting device was produced in the same manner as in Example 6 except that the surface treatment of the substrate in step-b of Example 6 was not carried out.

Step-a

The mask pattern of the photoresist (RD-2000N-41 available from Hitachi Kasei K.K.) having opening portions corresponding to the device electrode pattern was formed on the substrate 1 of soda lime glass, and a film of Pt was deposited in the thickness of 500 Å by sputtering. Then it was dissolved with the photoresist organic solvent and the Pt deposited film was lifted off, thereby forming the device electrodes 2, 3 (FIG. 7A). The spacing L between the device electrodes (FIG. 6A to FIG. 6C) was 10 μm.

Step-b

Using the ink jet device 8 of the ink jet method, four droplets of the palladium compound solution, which was prepared by weighing 0.6 g of the palladium acetate-tetraethanolamine complex, 0.05 g of 86% saponification polyvinyl alcohol, 25 g of isopropyl alcohol, and 1 g of ethylene glycol and adding water thereto up to the total amount of 100 g, were delivered to between the device electrodes 2, 3 of the above substrate 1 (FIG. 7C). The droplets 9 delivered at this time expanded up to the diameter of 100 μm on the substrate 1, thereby forming a circular dot.

Step-c

After the delivery of droplets, the substrate was heated at 300° C. for two hours to form the conductive film 4 of fine particles of palladium oxide (FIG. 7D). The conductive film 4 of palladium oxide had the nearly circular shape and the diameter (dot diameter) thereof was 100 μm.

Step-d

Next, the energization forming was carried out by applying the voltage between the device electrodes 2, 3 under the vacuum of $1.3\times10^{-4}$ Pa, thereby forming the fissure 5 in the conductive film 4 (FIG. 7E). The voltage waveform of the energization forming was the one illustrated in FIG. 4B, the pulse width T1 was 0.1 msec, the pulse separation T2 was 25 msec, and the peak voltages were 0 to 18 V.

Step-e

Then three droplets of the N-methylpyrrolidone solution containing polyamic acid 0.8% as a precursor of polyimide were delivered onto the conductive films 4 of fine particles of palladium oxide by use of the ink jet device 8 of the ink jet method (FIG. 3F). The solution spread on the conductive films 4 and stopped at the outer edges thereof.

Step-f

Then the substrate was baked at 350° C. in the atmosphere for 30 minutes to form the organic film 41 of polyimide on the conductive films 4. The organic film 41 thus formed had the nearly circular shape and the maximum overhang portion D of the organic film 41 from the edges of the conductive films 4 on the substrate 1, as illustrated in FIG. 9, was 7 μm in the region between the device electrodes 2, 3.

Step-g

Then, after evacuation to the vacuum of not more than $1.3\times10^{-5}$ Pa, the driving voltages from 0 to 25 V were applied and then it was found that a large ohmic current flowed to leak, in addition to the current associated with the electron emission current.

It was thus proved by Example 6 and Comparative Example 1 above that the electron emitting device without leakage was obtained as long as the overhang portions of the organic films on the conductive films were not more than 5 μm but the large leak current flowed if the overhang portions of the organic films were 7 μm.

Example 7

The organic film 41 of polyimide was deposited on the conductive film 4 in a manner similar to step-a to step-g of Example 6, this was put into the vacuum vessel illustrated in FIG. 5, and the carbonization operation was carried out in a flowing state of argon gas under the atmospheric pressure. The voltage applied was the same as in step-h of Example 6.

The electron-emitting device of the present example produced as described above had the electron emission characteristics similar to those of Example 6.

Example 8

Step-a

Figure 10A:
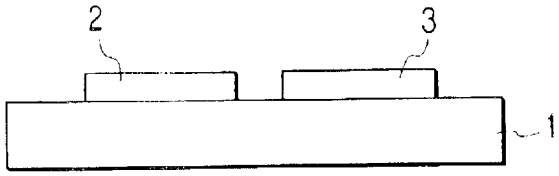
FIG. 10A, FIG. 10B, FIG. 10C and FIG. 10D are schematic diagrams to show another example of the producing method of the electron emitting device illustrated in FIG. 6A, FIG. 6B and FIG. 6C.

As in the case of Example 7, the mask pattern of the photoresist (RD-2000N-41 available from Hitachi Kasei K.K.) having opening portions corresponding to the device electrode pattern was formed on the substrate 1 of soda lime glass, and the film of Pt was deposited in the thickness of 500 Å by sputtering. Then it was dissolved with the photoresist organic solvent and the Pt deposited film was lifted off, thereby forming the device electrodes 2, 3 (FIG. 10A). The spacing L between the device electrodes (FIG. 6A to FIG. 6C) was 10 μm.

Step-b

Figure 10B:
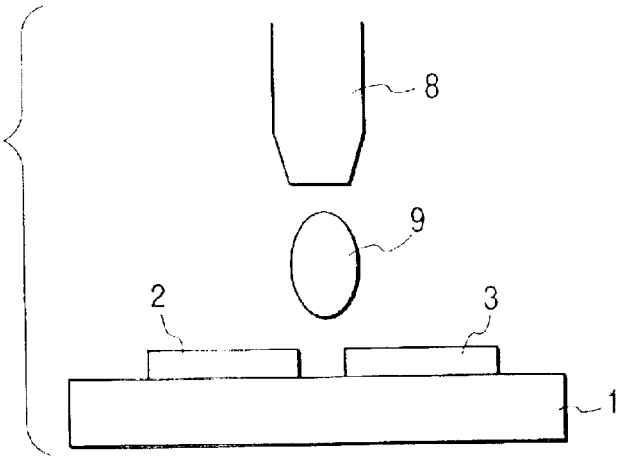

After the substrate 1 with the device electrodes 2, 3 formed thereon was cleaned well, four droplets (two dots) of the palladium compound solution, which was prepared by weighing 0.6 g of the palladium acetate-tetraethanolamine complex, 0.05 g of 86% saponification polyvinyl alcohol, 25 g of isopropyl alcohol, and 1 g of ethylene glycol and adding water thereto up to the total amount of 100 g, were delivered from the ink jet device 8 of the ink jet method to between the device electrodes 2, 3 of the substrate 1 (FIG. 10B). The droplets 9 delivered at this time expanded up to the diameter of 150 μm on the surface of the substrate, thereby forming a circular dot.

Step-c

Figure 10C:
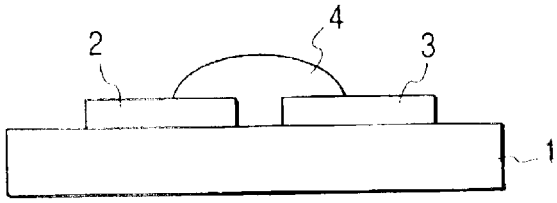

After the delivery of droplets, the substrate was heated at 300° C. for two hours to form the conductive film 4 of fine particles of palladium oxide. The conductive film 4 of palladium oxide had the nearly circular shape and the diameter (dot diameter) thereof was 150 μm (FIG. 10C).

Step-d

Figure 10D:
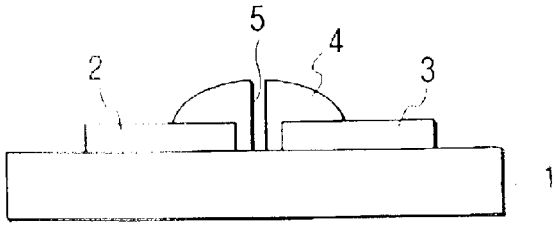

Next, the energization forming was carried out by applying the voltage between the device electrodes 2, 3 under the vacuum of $1.3\times10^{-4}$ Pa, thereby forming the fissure 5 in the conductive film 4 (FIG. 10D). The voltage waveform of the energization forming was the one illustrated in FIG. 4B, the pulse width T1 was 0.1 msec, the pulse separation T2 was 25 msec, and the peak voltages were 0 to 18 V.

Step-e

Then the device after completion of the above forming was set in the vacuum chamber of FIG. 5, and mixed gas of hydrogen 2%/nitrogen 98% was allowed to flow into the chamber while keeping the substrate temperature at 50° C. Approximately 30 minutes after, the palladium oxide films were reduced to metal palladium films 4'. The end of the reduction reaction was judged by checking that a palladium oxide film for monitor set in the same chamber demonstrated decrease of its electrical resistance and thereafter the resistance was settled at a constant value.

Step-f

Figure 11E:
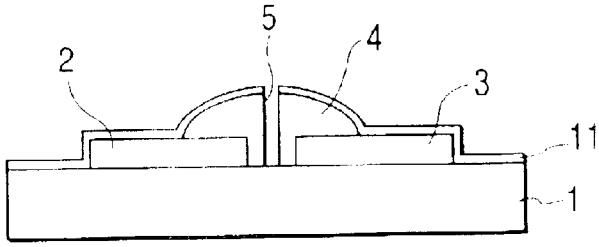
FIG. 11E, FIG. 11F, FIG. 11G and FIG. 11H are schematic diagrams to show another example of the producing method of the electron emitting device illustrated in FIG. 6A, FIG. 6B and FIG. 6C.

Then the surface of the substrate was exposed to vapor of dimethyldimethoxysilane at room temperature for one hour, whereby the surface treatment film was deposited over the entire surface of the substrate (FIG. 11E). Numeral 11 in FIG. 11E designates the surface treatment film.

After that, the substrate was heated at 350° C. in the atmosphere for 30 minutes.

Figure 11F:
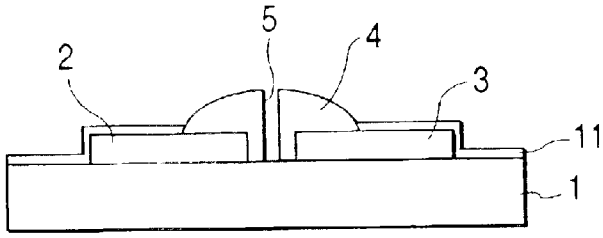

Under this condition the metal Pd film is oxidized again, but the Pt electrode film is kept in the metal state. Therefore, only the area over the Pd films out of the surface treatment film deposited on the entire surface of the substrate is decomposed by the oxidation reaction of the Pd films. As a result, the difference is made in the wettability between the surfaces on the Pd films and the other surfaces (FIG. 11F).

Step-g

Then three droplets of the N-methylpyrrolidone solution containing polyamic acid 0.8% as a precursor of polyimide were delivered onto the conductive films 4 of fine particles of palladium oxide by use of the ink jet device 8 of the ink jet method. The solution spread on the conductive films 4 and stopped at the outer edges thereof.

Step-h

Figure 11G:
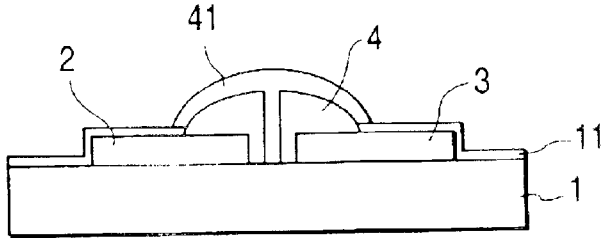

After that, the substrate was baked at 350° C. in the atmosphere for 30 minutes to form the organic film 41 of polyimide on the conductive films 4 (FIG. 11G). The organic film 41 thus formed had the nearly circular shape and the maximum overhang portion D of the organic film 41 from the edges of the conductive films 4 on the substrate 1, as illustrated in FIG. 9, was 3 μm in the region between the device electrodes 2, 3.

Step-i

Next, after evacuation to the vacuum of not more than $1.3\times10^{-5}$ Pa, the driving voltages from 0 to 25 V were applied to effect the carbonization operation. The voltage pulses applied during the carbonization step were similar to those applied during the forming.

Figure 11H:
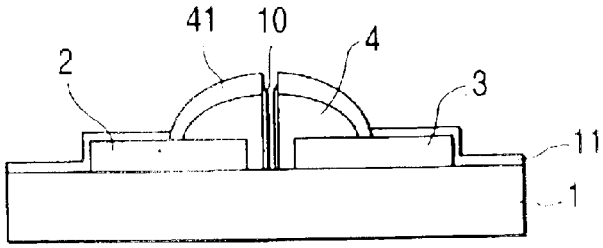

The above step created the fissure 7 in the organic film 41 of polyimide along the fissure 5 of the conductive films 4 of palladium oxide created by the above forming operation, the organic films 41 were carbonized near the fissure 7, and thus the carbon films 10 were formed on the ends of the conductive films 4 facing the fissure 5 (FIG. 11H).

The electron emitting device produced as described above was subjected to the measurement of the electron emission characteristics after evacuation to the vacuum of not more than $1.3\times10^{-5}$ Pa, using the measurement system illustrated in FIG. 5 and applying the driving voltage of 25 V and the anode voltage of 1 kV. Then the device current If=0.7 mA, the emission current Ie=8.0 μA, and thus the good electron emission characteristics were demonstrated.

Example 9

The device of the present example was produced in the same manner as in Example 6 except that the entire surface of the substrate 1 was surface-treated by applying a perfluoroethyltrimethoxysilane solution onto the surface of the substrate 1 similar to that in Example 6, by the spinner method and baking it at 150° C. for fifteen minutes.

The electron emitting device produced as described above had the electron emission characteristics similar to those in Example 6.

Example 10

The surface treatment, the formation of Pd oxide film, and the energization forming operation were carried out in the same manner as in Example 6.

Then two droplets of an N,N-dimethylacetamide solution of polyacrylonitrile 1% were delivered onto the conductive films 4 of fine particles of palladium oxide by use of the ink jet device of the ink jet method. The solution spread on the conductive films and stopped at the outer edges thereof.

Next, the substrate was baked at 250° C. in the atmosphere for 30 minutes to form the organic film 41 of polyacrylonitrile on the conductive films 4. The organic film 41 thus formed had the nearly circular shape and the maximum overhang portion D of the organic film 41 from the edges of the conductive films 4 on the substrate 1, as illustrated in FIG. 9, was 5 μm in the region between the device electrodes 2, 3.

Then, after evacuation to the vacuum of not more than $1.3\times10^{-5}$ Pa, the driving voltages from 0 to 25 V were applied to effect the carbonization operation. The voltage pulses applied during the carbonization step were similar to those applied during the forming.

The above step created the fissure 7 in the organic film 41 of polyacrylonitrile along the fissure of the conductive films 4 of palladium oxide created by the above forming operation, the organic films 41 were carbonized near the fissure 7, and thus the carbon films 10 were formed on the ends of the conductive films 4 facing the fissure 5.

The electron emitting device produced as described above was subjected to the measurement of the electron emission characteristics after evacuation to the vacuum of not more than $1.3\times10^{-5}$ Pa, using the measurement system illustrated in FIG. 5 and applying the driving voltage of 25 V and the anode voltage of 1 kV. Then the device current If=0.6 mA, the emission current Ie=6.0 μA, and thus the good electron emission characteristics were demonstrated.

Example 11

The electron source substrate of the matrix shape and the image forming apparatus as illustrated in FIG. 12 and FIG. 13 were produced by applying the surface conduction electron emitting device of Example 6.

A mask pattern of the photoresist (RD-2000N-41 available from Hitachi Kasei K.K.) having opening portions corresponding to the device electrode pattern was formed on the substrate 71 of soda lime glass, and a film of Pt was deposited in the thickness of 500 Å by sputtering. Next, it was dissolved with the photoresist organic solvent and the Pt deposited film was lifted off, thereby forming plural pairs of device electrodes 2, 3. The spacing L between each pair of device electrodes was 10 μm.

The X-directional wires 72 and Y-directional wires 73 were formed by printing a pattern of an Ag paste by a screen printing method and heating to bake it, whereby the above plural pairs of device electrodes 2, 3 were matrix-wired. A pattern of an insulating paste was printed at the intersections between the X-directional wires 72 and the Y-directional wires 73 by the screen printing method and was heated to bake it, thereby forming the insulating layer not illustrated.

The substrate 71 with the device electrodes and wires formed thereon was subjected to the surface treatment similar to that in Example 6.

Four droplets of the palladium compound solution, which was prepared by weighing 0.6 g of the palladium acetate-tetraethanolamine complex, 0.05 g of 86% saponification polyvinyl alcohol, 25 g of isopropyl alcohol, and 1 g of ethylene glycol and adding water thereto up to the total amount of 100 g, were delivered onto between each pair of the device electrodes 2, 3 on the surface-treated substrate 1 in the same manner as in Example 6. The droplets dispensed at this time spread in the right circular shape having the diameter of 100 μm.

After the delivery of droplets, the substrate was heated at 300° C. for two hours to form the conductive films 4 of fine particles of palladium oxide. The conductive films 4 of palladium oxide had the nearly circular shape and the diameter (dot size) thereof was 100 μm.

In the electron source substrate produced in this way, the voltages of 0 to 18 V were applied between the device electrodes 2, 3 through the X-directional wires and Y-directional wires to perform the forming in the same manner as in Example 6, thus forming the fissure 5 in each conductive film 4.

Next, three drops of the N-methylpyrrolidone solution containing polyamic acid 0.8% as a precursor of polyimide were delivered from the ink jet device of the ink jet method onto each of the conductive films 4 of fine particles of palladium oxide in the same manner as in Example 6. The solution spread on the conductive films and stopped at the outer edges thereof.

Then the substrate was baked at 350° C. in the atmosphere for 30 minutes to form the organic film 41 of polyimide on the conductive films 4. The organic films 41 thus formed had the nearly circular shape and the maximum overhang portion D of the organic films 4 from the edges of the conductive films 4 on the substrate 1, which is illustrated in FIG. 9, was 5 μm in the regions between the device electrodes 2, 3.

The electron source substrate 71 produced in this way was fixed onto the rear plate 81, thereafter the face plate 86 (in the structure of the fluorescent film and metal back formed on the inner surface of the glass substrate) was set 5 mm above the substrate through the support frame 82, and they were hermetically bonded at 400° C. with frit glass. The fluorescent film was one in which the three colors of R, G, and B were arranged in the stripe pattern.

The inside of the glass vessel produced was evacuated by a vacuum pump through an exhaust pipe and thereafter the carbonization operation was carried out by applying the driving voltages of 0 to 25 V through the external terminals outside the vessel. The voltage pulses applied during the carbonization step were similar to those during the forming.

The above step created the fissure 7 in each organic film 41 of polyimide along the fissure 5 created in each conductive film 4 by the above forming operation and the organic films 41 were carbonized near the fissures 7. The carbon films 10 were formed on the ends of the conductive films 4 facing the fissure 5.

The inside of the vessel was evacuated well and the getter operation was carried out further in order to maintain the vacuum degree. After that, the exhaust pipe was fused by a gas burner to seal the vessel, thus producing the image forming apparatus.

In the image forming apparatus completed as described above, the voltage of 25 V was applied through the external terminals to each electron emitting device and the voltage of 4 kV to the metal back through the high-voltage terminal, whereupon luminous spots were observed with good uniformity on the face plate.

Using the driving circuit as illustrated in FIG. 14, the apparatus was driven to perform the television display based on the NTSC television signals, whereupon good images were able to be displayed without luminance irregularity nor display irregularity throughout the entire surface.

Example 12

The electron source substrate and image forming apparatus of the ladder shape as illustrated in FIG. 15 and FIG. 16 were produced by applying the electron emitting device of Example 6.

The device electrodes 2, 3 were formed on the soda lime glass substrate 110 in the same manner as in Example 11 and the common wires 112 were made by the screen printing method.

Next, the surface treatment of the electrode substrate was carried out and the conductive films 4 and organic films 41 were formed in the same manner as in Example 11.

Using the electron source substrate 110 thus produced, the image forming apparatus as illustrated in FIG. 16 was produced in the same manner as in Example 11, except that the grid electrode 120 was placed between the electron source substrate 110 and the face plate 86.

In the image forming apparatus completed as described above, modulation signals for each line of an image were applied simultaneously to the grid electrode columns in synchronism with the successive driving (scanning) of the device rows row by row, whereby the image was able to be displayed line by line while controlling irradiation of each electron beam to the fluorescent material.

The voltage of 25 V was applied through the external terminals to each electron emitting device and the voltage of 4 kV to the metal back through the high-voltage terminal, whereupon luminous spots were observed with good uniformity on the face plate.

The present invention can provide the electron emitting device in which the unwanted influence of the organic film laid on the electron emitting device, upon the electron emission characteristics is reduced to the utmost, and the electron source, and the producing methods thereof.

The present invention can also provide the electron emitting device with the improved electron emission efficiency, and the electron source, and the production methods thereof.

The present invention can also provide the electron source provided with a plurality of electron emitting devices excellent in the uniformity of the electron emission characteristics, and the producing method thereof.

The present invention can also provide the image forming apparatus capable of forming images with high quality, and the producing method thereof.

What is claimed is:

1. A method for producing an electron emitting device, the producing method comprising a step of forming an electrically conductive film on a substrate, a step of forming an organic film on said conductive film, and a step of energizing the conductive film with said organic film formed thereon, wherein said step of forming the organic film comprises a step of delivering a liquid comprising a material for forming said organic film, onto said conductive film by an ink jet method, and wherein said organic film is formed so that an overhang portion of the organic film from an edge of said conductive film on the substrate is not more than 5 $\mu$m.

2. A method for producing an electron emitting device, the producing method comprising a step of forming an electrically conductive film on a substrate, a step of forming an organic film on said conductive film, and a step of energizing the conductive film with said organic film formed thereon, wherein said step of forming the organic film comprises a step of delivering a liquid comprising a material for forming said organic film, onto said conductive film by an ink jet method, said producing method further comprising a step of making a difference in wettability against said liquid between a surface of said conductive film and a surface of said substrate, prior to said step of forming the organic film.

3. A method for producing an electron emitting device, the producing method comprising a step of forming an electrically conductive film on a substrate, a step of forming an organic film on said conductive film, and a step of energizing the conductive film with said organic film formed thereon, wherein said step of forming the organic film comprises a step of delivering a liquid comprising a material for forming said organic film, onto said conductive film by an ink jet method, said producing method further comprising a step of subjecting said substrate to a surface treatment for decreasing wettability of a surface of the substrate against said liquid, prior to said step of forming the organic film.

4. The producing method according to any one of claims 1 to 3, wherein said liquid is a liquid containing polyamic acid, an amine, and an organic solvent.

5. The producing method according to claim 4, wherein said amine is at least one selected from diethanolamine, triethanolamine, and trishydroxymethylaminomethane.

* * * * *

UNITED STATES PATENT AND TRADEMARK OFFICE

CERTIFICATE OF CORRECTION

PATENT NO. : 6,827,619 B2
DATED : December 7, 2004
INVENTOR(S) : Hitoshi Oda et al.

It is certified that error appears in the above-identified patent and that said Letters Patent is hereby corrected as shown below:

Title page,
Item [56], References Cited, U.S. PATENT DOCUMENTS,
"JP 2000251683 A" should read -- JP 2000-251683 A --.

Column 1,
Line 36, "conductive," should read -- conductive --.

Column 12,
Line 5, "γaminopropyltrimethoxysilane," should read
-- γ-aminopropyltrimethoxysilane, --.
Line 6, "γaminopropylmethyldimethoxysilane," should read
-- γ-aminopropylmethyldimethoxysilane, --.

Column 29,
Line 25, "Example 7" should read -- Example 6 --.

Signed and Sealed this

Third Day of May, 2005

JON W. DUDAS
*Director of the United States Patent and Trademark Office*